US011319716B2

(12) United States Patent
Machida et al.

(10) Patent No.: US 11,319,716 B2
(45) Date of Patent: May 3, 2022

(54) REBAR TYING MACHINE

(71) Applicant: MAKITA CORPORATION, Anjo (JP)

(72) Inventors: Yoshitaka Machida, Anjo (JP); Tadasuke Matsuno, Anjo (JP)

(73) Assignee: MAKITA CORPORATION, Anjo (JP)

( * ) Notice: Subject to any disclaimer, the term of this patent is extended or adjusted under 35 U.S.C. 154(b) by 497 days.

(21) Appl. No.: 16/204,245

(22) Filed: Nov. 29, 2018

(65) Prior Publication Data

US 2019/0194958 A1 Jun. 27, 2019

(30) Foreign Application Priority Data

Dec. 25, 2017 (JP) ..... JP2017-248400

(51) Int. Cl.
*B21F 15/04* (2006.01)
*E04G 21/12* (2006.01)

(52) U.S. Cl.
CPC ..... *E04G 21/123* (2013.01); *B21F 15/04* (2013.01)

(58) Field of Classification Search
CPC ..... E04G 21/122; E04G 21/123; B21F 15/02; B21F 15/04; B65B 13/025; B65B 13/027; B65B 13/04
See application file for complete search history.

(56) References Cited

U.S. PATENT DOCUMENTS

| | | | | |
|---|---|---|---|---|
| 2006/0283516 | A1 | 12/2006 | Nagaoka et al. | |
| 2007/0199610 | A1* | 8/2007 | Itagaki | E04G 21/122 140/93.6 |
| 2009/0283170 | A1 | 11/2009 | Nagaoka | |
| 2010/0313991 | A1 | 12/2010 | Nagaoka et al. | |
| 2017/0218631 | A1* | 8/2017 | Matsuno | E04C 5/166 |
| 2020/0149279 | A1 | 5/2020 | Matsuno | |

FOREIGN PATENT DOCUMENTS

| | | | |
|---|---|---|---|
| CN | 101585423 | A | 11/2009 |
| CN | 205113772 | U * | 3/2016 |
| CN | 205113772 | U | 3/2016 |
| CN | 107031891 | A | 8/2017 |
| JP | H06-170477 | A | 6/1994 |
| JP | 2005-194847 | A | 7/2005 |
| JP | 2009-275485 | A | 11/2009 |
| JP | 2017-172111 | A | 9/2017 |

OTHER PUBLICATIONS

Jul. 13, 2021 Office Action issued in Japanese Patent Application No. 2017-248400.
Mar. 26, 2021 Office Action issued in Chinese Patent Application No. 201811582232.7.

* cited by examiner

*Primary Examiner* — Debra M Sullivan
(74) *Attorney, Agent, or Firm* — Oliff PLC

(57) ABSTRACT

A rebar tying machine configured to tie rebars with a wire is disclosed. The rebar tying machine may include a housing. The hosing may include a communication portion that allows iron powder to move therethrough from outside to inside of the housing. The rebar tying machine may include a collecting magnet configured to collect the iron powder.

7 Claims, 36 Drawing Sheets

REBAR TYING MACHINE

CROSS-REFERENCE

This application claims priority to Japanese Patent Application No. 2017-248400, filed on Dec. 25, 2017, the entire contents of which are incorporated herein by reference.

TECHNICAL FIELD

The technique disclosed herein relates to a rebar tying machine.

BACKGROUND

Japanese Patent Application Publication No. 2009-275485 describes 4 rebar tying machine that ties rebars with a wire. This rebar tying machine includes a housing. The housing is provided with a communication portion which allows iron powder to move therethrough from outside to inside of the housing.

SUMMARY

Iron powder may be generated by a wire being scraped in the course of work for tying rebars with the wire. When this iron powder enters inside a housing through a communication portion, it might adversely affecting operations of devices housed inside the housing. The disclosure herein provides a technique capable of suppressing operations of devices housed inside a housing in a rebar tying machine configured to tie rebars with a wire from being adversely affected by iron powder from the wire.

A rebar tying machine configured to tie rebars with a wire is disclosed herein. The rebar tying machine may comprise a housing including a communication portion that allows iron powder to move therethrough from outside to inside of the housing, and a collecting magnet configured to collect the iron powder.

According to the above configuration, even when the wire is scraped and iron powder is generated, the collecting magnet collects the iron powder, as a result of which the iron powder is suppressed from adversely affecting operations of devices housed inside the housing.

Another rebar tying machine configured to tie rebars with a wire is also disclosed herein. The rebar tying machine may comprise a collecting magnet configured to collect iron powder.

According to the above configuration, even when the wire is scraped and iron powder is generated, the collecting magnet collects the iron powder, as a result of which the iron powder is suppressed from adversely affecting operations of devices of the rebar tying machine.

DETAILED DESCRIPTION

Figure 1:
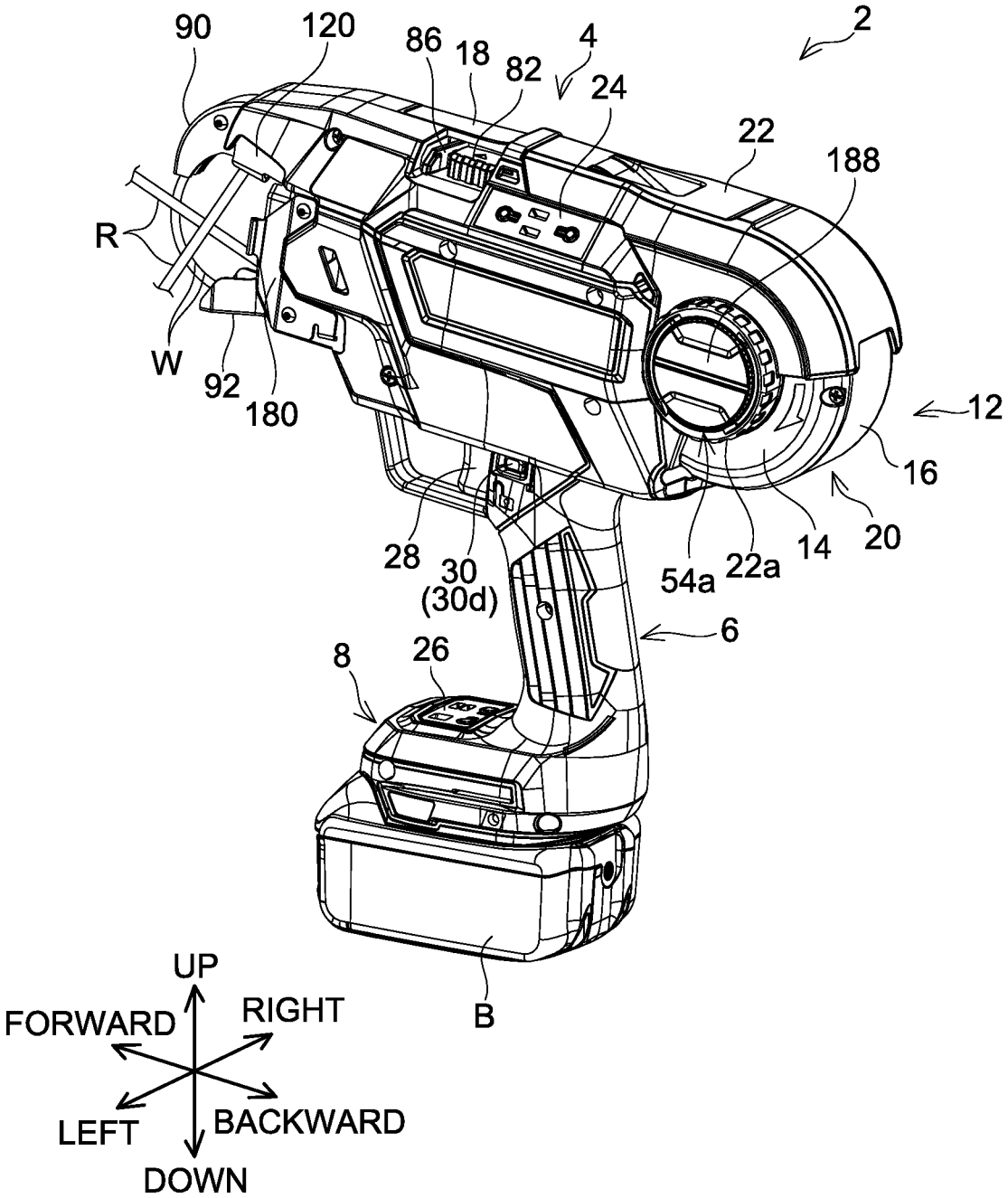
FIG. 1 is a perspective view seeing a rebar tying machine 2 according to an embodiment from an upper left rear side.

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved rebar tying machines, as well as methods for using and manufacturing the same.

Moreover, combinations of features and steps disclosed in the following detailed description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, a rebar tying machine may be configured to tie rebars with a wire. The rebar tying machine may comprise a housing. The housing may include a communication portion that allows iron powder to move therethrough from outside to inside of the housing. The communication portion disclosed herein may be, for example, an opening provided in the housing, and may be an abutment portion between housing plates in a case where the housing is constituted of a plurality of housing plates. The rebar tying machine may comprise a collecting magnet configured to collect the iron powder.

According to the above configuration, even when the wire is scraped and iron powder is generated, the collecting magnet collects the iron powder, so the iron powder can be suppressed from adversely affecting operations of devices housed inside the housing.

In one or more embodiments, the collecting magnet may be provided inside the housing.

According to the above configuration, even when the iron powder enters inside the housing, the collecting magnet collects the iron powder, so the iron powder can be suppressed from adversely affecting the operations of the devices housed inside the housing.

In one or more embodiments, the rebar tying machine may further comprise a magnetic sensor provided inside the housing, and a sensor magnet provided inside the housing to correspond to the magnetic sensor. Inside the housing, the collecting magnet may be disposed on a path along which the iron powder moves from the communication portion to the sensor magnet.

In a case where the magnetic sensor and the sensor magnet are housed inside the housing of the rebar tying machine, when the iron powder that entered the housing adheres to the sensor magnet, this may adversely affect detection of the sensor magnet by the magnetic sensor.

According to the above configuration, the collecting magnet is disposed on the path along which the iron powder moves from the communication portion toward the sensor magnet. Therefore, even when the iron powder enters inside the housing, the iron powder can be suppressed from moving from the communication portion to the sensor magnet.

In one or more embodiments, the collecting magnet may be attached to an inner wall surface of the housing.

In the rebar tying machine, the iron powder that entered inside the housing tends to move along the inner wall surface of the housing. According to the above configuration, the iron powder that entered inside the housing can effectively be collected by the collecting magnet.

In one or more embodiments, the collecting magnet may be provided outside the housing.

According to the above configuration, even when the wire is scraped and iron powder is generated, the collecting magnet outside the housing collects the iron powder before the iron powder enters inside the housing, so the entry of the iron powder inside the housing can be suppressed.

In one or more embodiments, the collecting magnet may be attached to a portion of an outer wall surface of the housing near the communication portion.

According to the above configuration, the collecting magnet can collect the iron powder before the iron powder enters inside the housing from the communication portion of the housing.

In one or more embodiments, the rebar tying machine may further comprise a feeding roller configured to feed the wire. The communication portion may be disposed near the feeding roller.

In a configuration in which a feeding roller feeds out a wire, the wire is scraped by friction with the feeding roller, so iron powder is easily generated near the feeding roller. Due to this, when a communication portion is present near the feeding roller, the iron powder is likely to enter inside the housing. According to the above rebar tying machine, the iron powder generated near the feeding roller is collected by the collecting magnet, so the iron powder can be suppressed from adversely affecting the operations of the devices housed inside the housing.

In one or more embodiments, the rebar tying machine may further comprise a hook configured to twist the wire. The communication portion may be disposed near the hook.

In a configuration in which a hook twists a wire, the wire is scraped by friction between portions of the wire in a process of the wire being twisted, so iron powder is easily generated near the hook. Due to this, when a communication portion is present near the hook, the iron powder is likely to enter inside the housing. According to the above rebar tying machine, the iron powder generated near the hook is collected by the collecting magnet, so the iron powder can be suppressed from adversely affecting the operations of the devices housed inside the housing.

In one or more embodiments, a rebar tying machine may be configured to tie rebars with a wire. The rebar tying machine may comprise a collecting magnet configured to collect iron powder.

According to the above configuration, even when the wire is scraped and iron powder is generated, the collecting magnet collects the iron powder, as a result of which the iron powder is suppressed from adversely affecting operations of devices of the rebar tying machine.

Embodiment

A rebar tying machine 2 according to an embodiment will be described with reference to the drawings. The rebar tying machine 2 shown in FIG. 1 is a power tool for tying a plurality of rebars R with a wire W.

Figure 2:
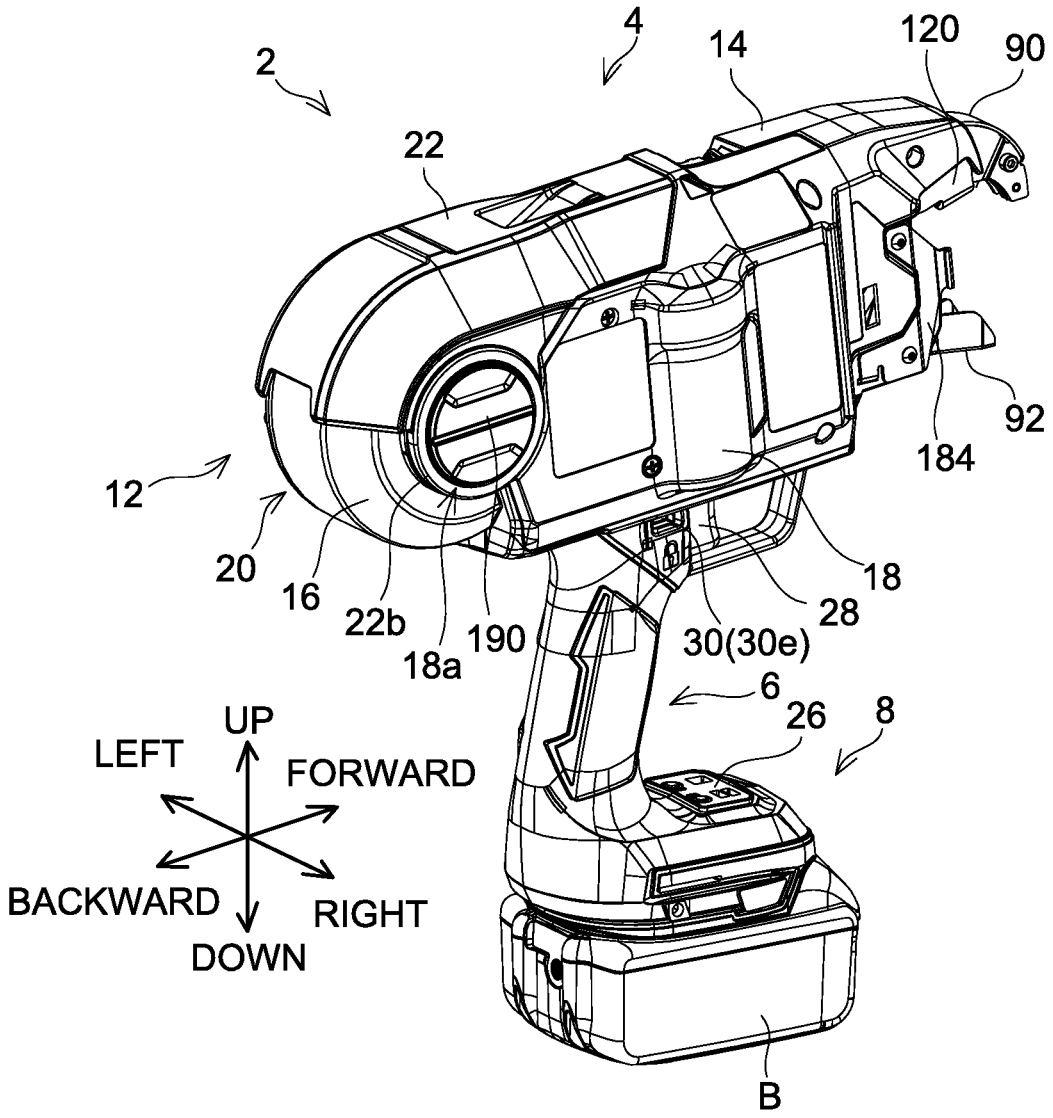
FIG. 2 is a perspective view seeing the rebar tying machine 2 according to the embodiment from an upper right rear side.
Figure 3:
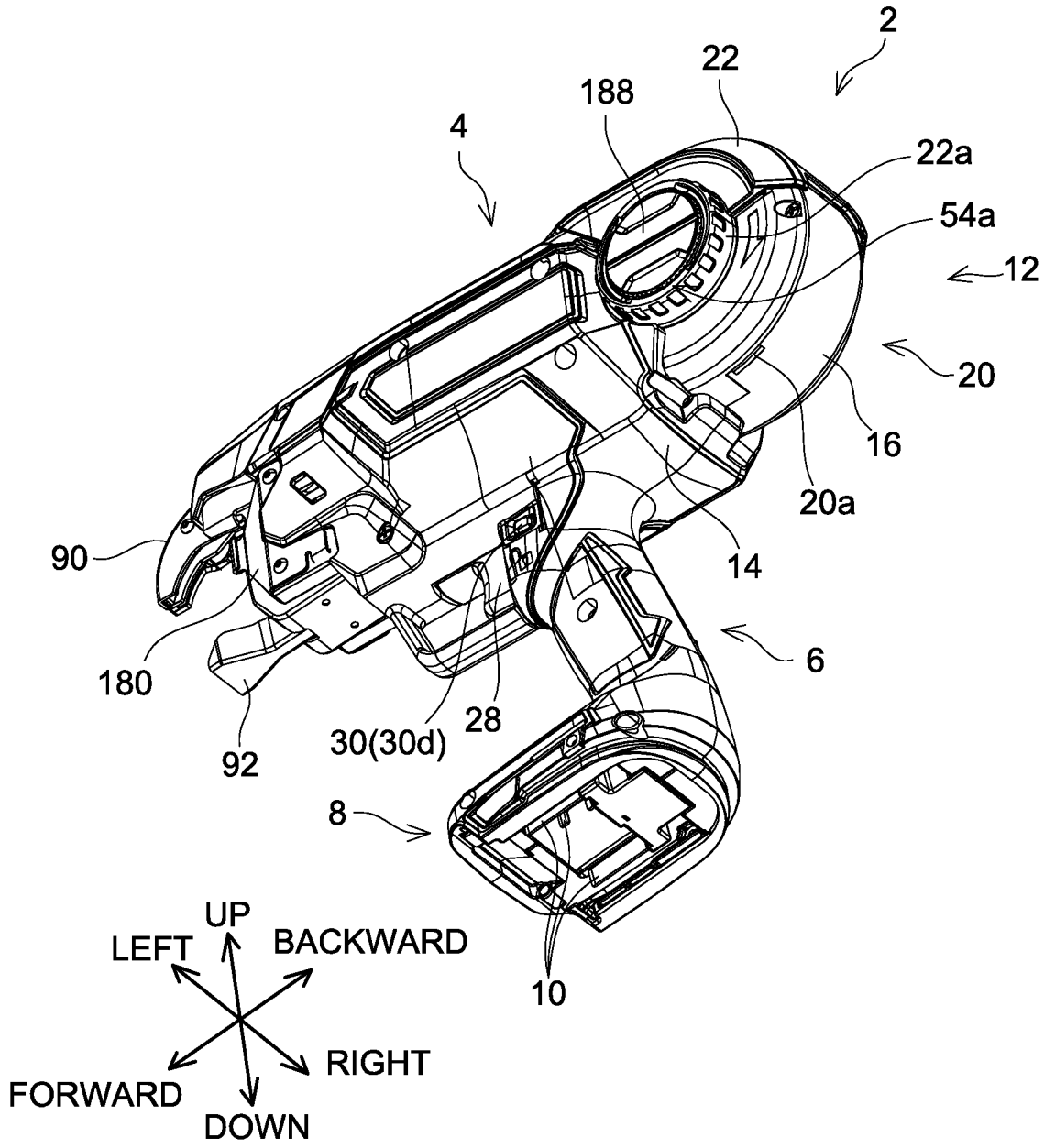
FIG. 3 is a perspective view seeing the rebar tying machine 2 according to the embodiment from a lower left rear side.

As shown in FIGS. 1 and 2, the rebar tying machine 2 includes a tying machine body 4, a grip 6 provided below the tying machine body 4 and which a user can grip, and a battery receiver 8 provided below the grip 6. A battery B is detachably attached to a lower part of the battery receiver 8. The battery B is a slide-type battery which is detachably attached by being slid relative to the battery receiver 8. The battery B is, for example, a lithium ion battery which is rechargeable by a charger which is not shown. When the battery B is attached to the battery receiver 8, power is supplied to the rebar tying machine 2 from the battery B. As shown in FIG. 3, battery terminals 10 configured to electrically connect with the battery B are provided on a lower surface of the battery receiver 8. The battery terminals 10 are electrically connected to a control board 200 (see FIG. 8) housed in a lower part of the tying machine body 4. The control board 200 controls various operations of the rebar tying machine 2.

As shown in FIGS. 1 and 2, the rebar tying machine 2 includes a housing 12. The housing 12 includes a left housing 14, a right housing 16, and a side-surface cover housing 18. The left housing 14, the right housing 16, and the side-surface cover housing 18 are all members constituted of resin. The left housing 14, the right housing 16, and the side-surface cover housing 18 can be regarded as a plurality of housing plates constituting the housing 12. As shown in FIG. 1, the left housing 14 integrally forms an outer shape of a left half of the tying machine body 4, an outer shape of a left half of the grip 6, and an outer shape of a left half of the battery receiver 8. As shown in FIG. 2, the right housing 16 integrally forms a part of an outer shape of a right half of the tying machine body 4, an outer shape of a right half of the grip 6, and an outer shape of a right half of the battery receiver 8. The left housing 14 is fixed to the right housing 16 with a plurality of screws. The side-surface cover housing 18 forms a part of the outer shape of the right half of the tying machine body 4. The side-surface cover housing 18 is fixed to the right housing 16 with a plurality of screws. A reel housing compartment 20 for housing a wire reel WR (see FIG. 7) is provided at a rear part of the tying machine body 4. The reel housing compartment 20 has its top part covered by a reel cover 22. The reel cover 22 is retained by the tying machine body 4 via circular ring-shaped attaching portions 22*a*, 22*b* provided respectively on left and right sides, and is configured to open and close the reel housing compartment 20 by rotating relative to the tying machine body 4 with a left-and-right direction as a rotary axis.

As shown in FIG. 1, a first manipulation/indicator unit 24 is provided at an upper left part of the tying machine body 4 near its center in a front-and-rear direction. The first manipulation/indicator unit 24 includes a main switch for switching power of the rebar tying machine 2 between on and off, a main power LED indicating an on/off state of the power of the rebar tying machine 2, and the like. The first manipulation/indicator unit 24 is electrically connected to the control board 200. The first manipulation/indicator unit 24 is arranged such that its manipulation/indicator surface inclines from an upper right side to a lower left side in a rear view of the tying machine body 4. With the first manipulation/indicator unit 24 arranged to incline as above, the user of the rebar tying machine 2 can achieve good visibility of the first manipulation/indicator unit 24 in either case of seeing the tying machine body 4 from the left side or from above. Further, with the first manipulation/indicator unit 24 arranged to incline as above, a dead space inside the tying machine body 4 can be reduced and the tying machine body 4 can be made compact as compared to a case where the first manipulation/indicator unit 24 is arranged along an upper surface or a side surface of the tying machine body 4.

A second manipulation/indicator unit 26 is provided on an upper front surface of the battery receiver 8. The second manipulation/indicator unit 26 includes setting buttons for setting a feed amount and twisting strength of the wire W, 7-segment LEDs for indicating contents set by the setting buttons, and the like. The second manipulation indicator unit 26 is electrically connected to the control board 200.

Figure 4:
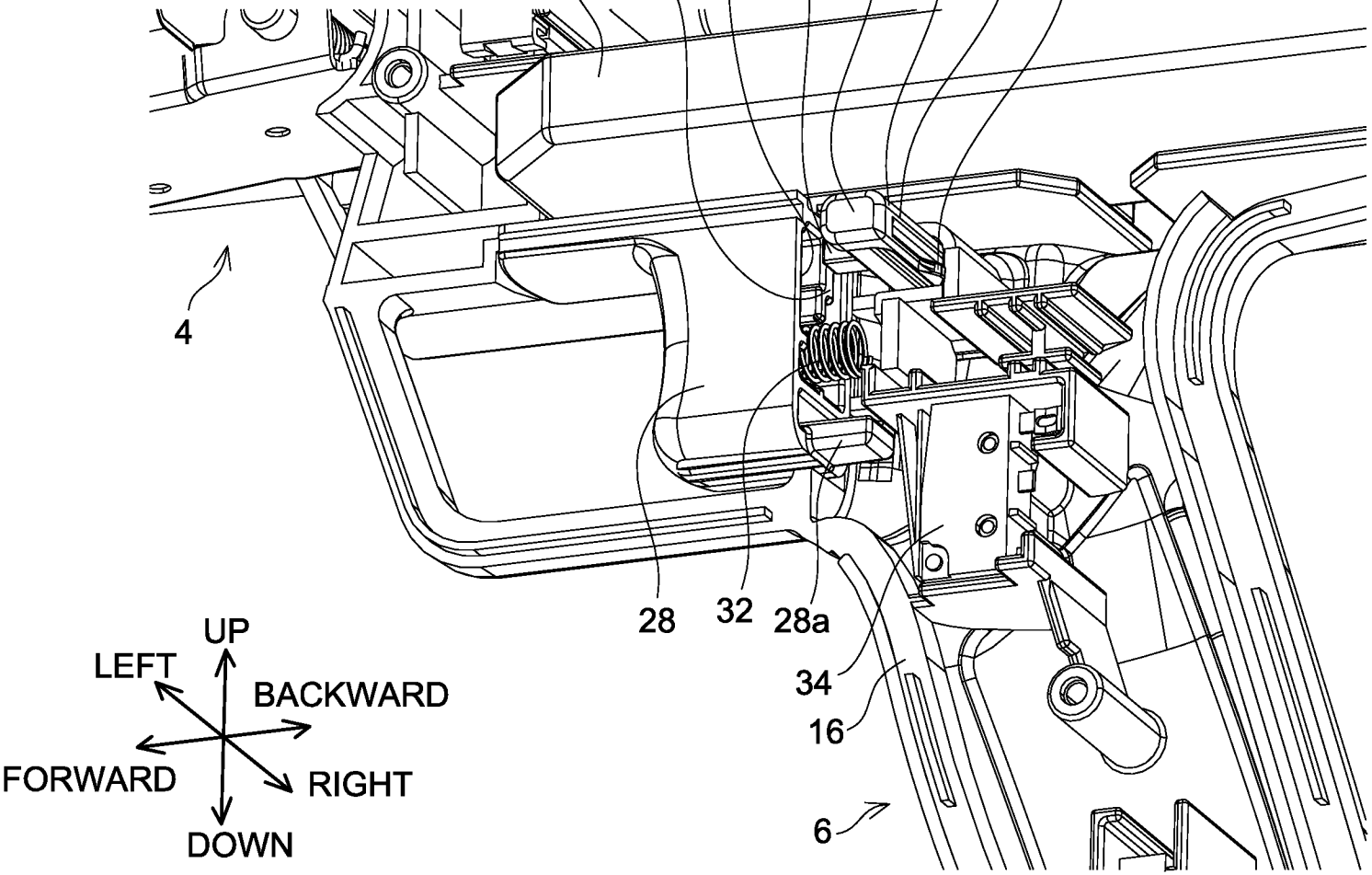
FIG. 4 is a perspective view seeing an internal structure of an upper portion of a grip 6 of the rebar tying machine 2 according to the embodiment from the lower left rear side.

At an upper front part of the grip 6, a trigger 28 which the user can manipulate to pull and a trigger lock 30 which is disposed behind the trigger 28 and is configured to switch between a state allowing the pulling manipulation on the trigger 28 and a state prohibiting the same are provided. The trigger 28 is retained by the left housing 14 and the right housing 16 so as to be slidable relative to the grip 6 in the front-and-rear direction. As shown in FIG. 4, the trigger 28 is biased forward by a compression spring 32 retained by the left housing 14 and the right housing 16. A protrusion 28*a* protruding rearward is provided at a lower rear part of the trigger 28. A trigger switch 34 is disposed at an upper part inside the grip 6. The trigger switch 34 is electrically connected to the control board 200. When the user places his/her finger on the trigger 28 and performs the pulling manipulation on the trigger 28 against biasing force of the compression spring 32, the trigger 28 moves rearward and the protrusion 28*a* presses on the trigger switch 34. When the user releases the finger from the trigger 28, the trigger 28 moves forward by the biasing force of the compression spring 32 and the protrusion 28*a* separates from the trigger switch 34.

Figure 5:
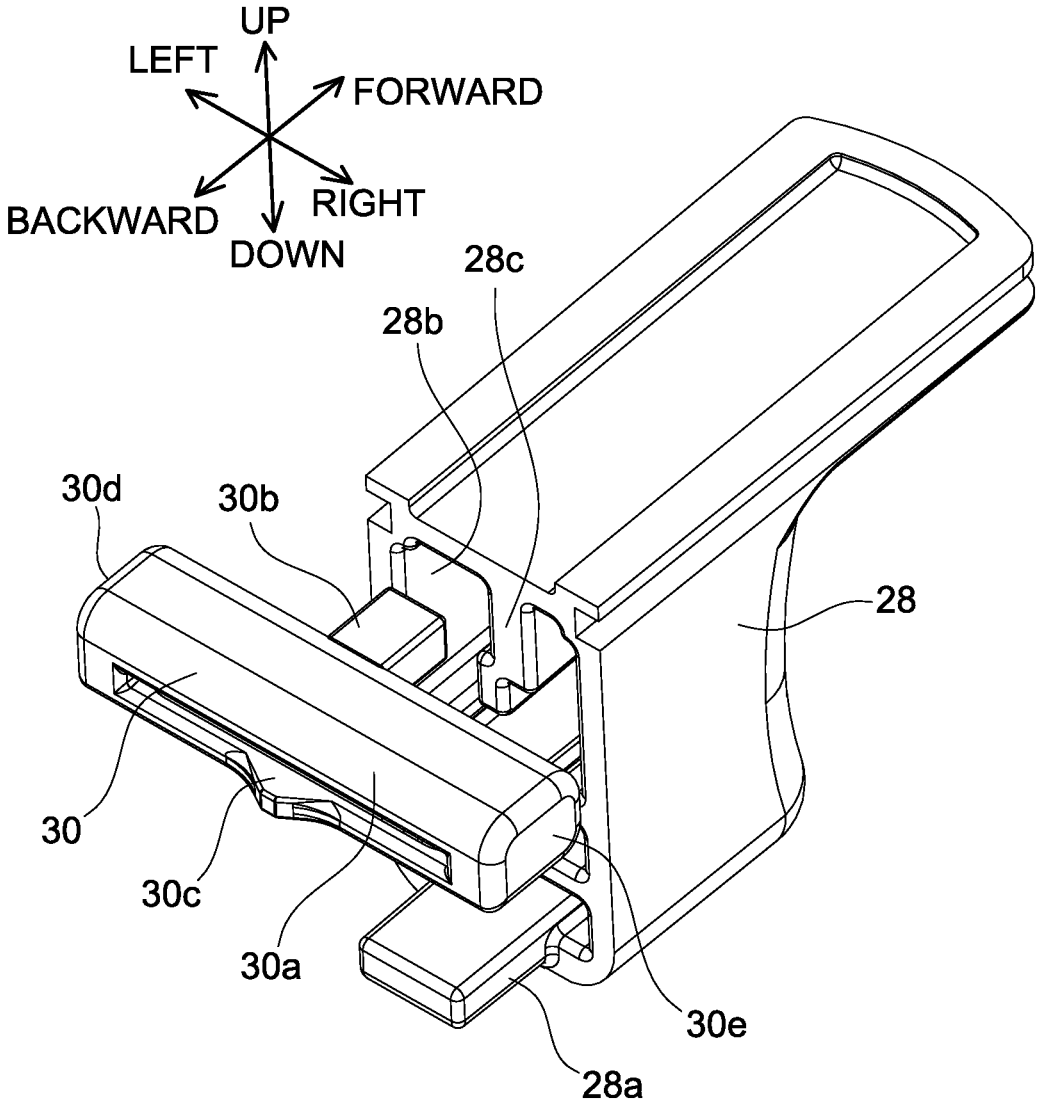
FIG. 5 is a perspective view seeing a trigger 28 and a trigger lock 30 from the upper right rear side when the trigger lock 30 is at an allowing position in the rebar tying machine 2 according to the embodiment.
Figure 6:
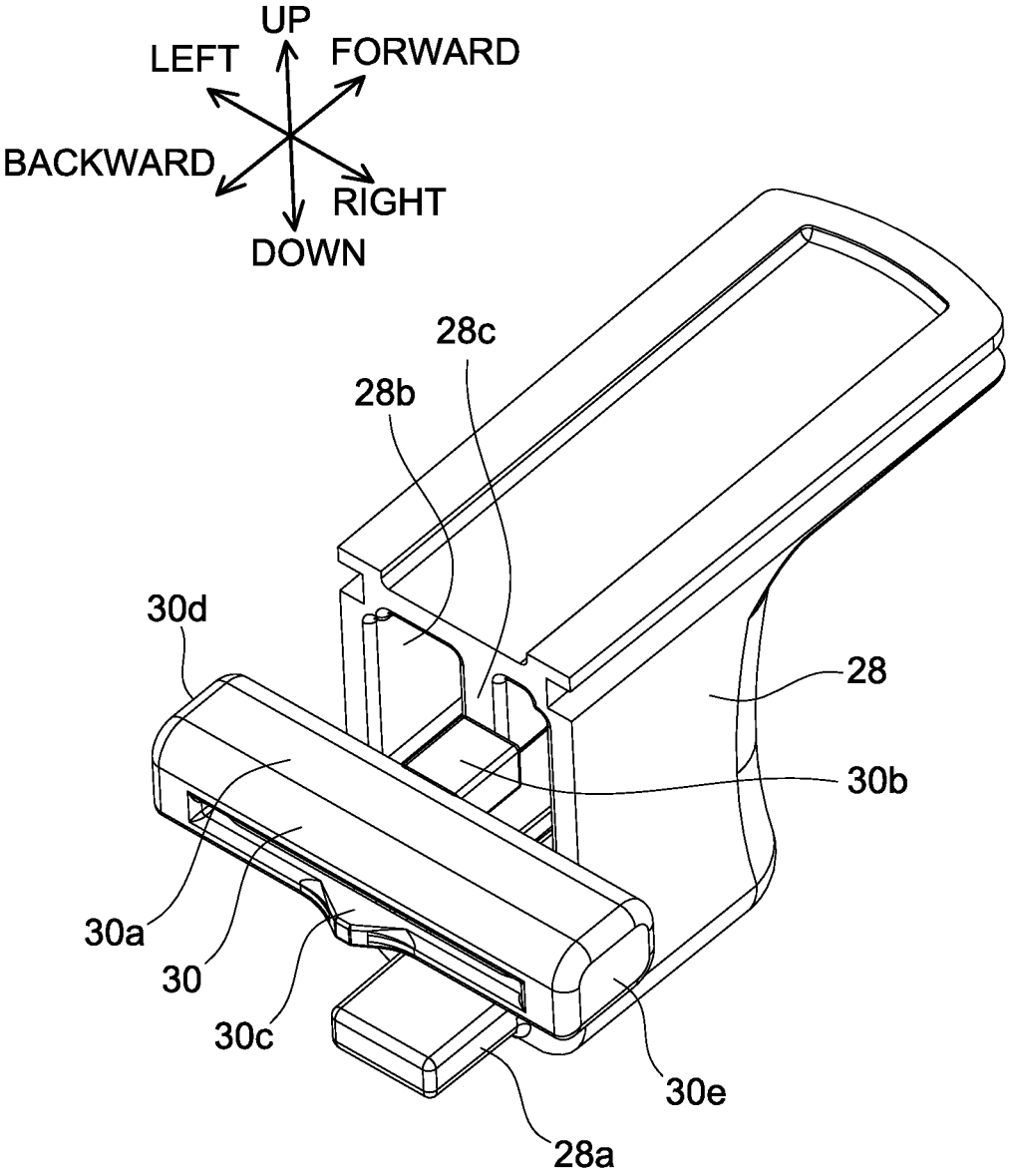
FIG. 6 is a perspective view seeing the trigger 28 and the trigger lock 30 from the upper right rear side when the trigger lock 30 is at a prohibiting position in the rebar tying machine 2 according to the embodiment.

As shown in FIGS. 5 and 6, the trigger lock 30 includes a base 30*a* extending linearly in the left-and-right direction, a protrusion 30*b* protruding forward from near a center of the base 30*a*, and an engaging portion 30*c* provided on a rear surface of the base 30*a* near the center thereof. As shown in FIGS. 1 and 2, a left end surface 30*d* and a right end surface 30*e* of the base 30*a* of the trigger lock 30 are respectively disposed so as to be exposed on a left surface and a right surface of the grip 6. The trigger lock 30 is retained by the left housing 14 and the right housing 16 so as to be slidable in the left-and-right direction relative to the grip 6. The trigger lock 30 is configured to move between an allowing position that allows the pulling manipulation on the trigger 28 and a prohibiting position that prohibits the pulling manipulation on the trigger 28. As shown in FIGS. 5 and 6, a recess 28*b* configured to receive the protrusion 30*b* and a stopper 28*c* configured to prohibit the reception of the protrusion 30*b* are provided at an upper rear part of the trigger 28. As shown in FIG. 5, when the trigger lock 30 is at the allowing position, the left end surface 30*d* of the trigger lock 30 protrudes outward than the left surface of the grip 6, and the engaging portion 30*c* is engaged with an engaged portion (not shown) provided on the left housing 14 and the right housing 16. Further, when the trigger lock 30 is at the allowing position, the protrusion 30*b* of the trigger lock 30 faces the recess 28*b* of the trigger 28. When the trigger 28 is moved rearward in this state, the protrusion 30*b* is received by the recess 28*b*, so the trigger 28 can move rearward. That is, when the trigger lock 30 is in the allowing position, the user can perform the pulling manipulation on the trigger 28. When the user pushes in the left end surface 30*d* of the trigger lock 30 from the left side of the grip 6 in the state where the trigger lock 30 is in the allowing position, the engagement of the engaging portion 30*c* of the trigger lock 30 is released, and the trigger lock 30 slides in the right direction to move to the prohibiting position. As shown in FIG. 6, when the trigger lock 30 is in the prohibiting position, the right end surface 30*e* of the trigger lock 30 protrudes outward than the right surface of the grip 6, and the engaging portion 30*c* is engaged with the engaged portion (not shown) provided on the left housing 14 and the right housing 16. Further, when the trigger lock 30 is in the prohibiting position, the protrusion 30*b* of the trigger lock 30 faces the stopper 28*c* of the trigger 28. When the trigger 28 is moved rearward in this state, the protrusion 30*b* comes to contact with the stopper 28*c*, and further rearward movement of the trigger 28 is thereby prohibited. That is, when the trigger lock 30 is in the prohibiting position, the user's pulling manipulation on the trigger 28 is prohibited. When the user pushes in the right end surface 30*e* of the trigger lock 30 from the right side of the grip 6 in the state where the trigger lock 30 is in the prohibiting position, the engagement of the engaging portion 30*c* of the trigger lock 30 is released, and the trigger lock 30 slides in the left direction to move to the allowing position. Since the rebar tying machine 2 of the present embodiment uses the slid-type trigger lock 30 as above, a mechanical configuration thereof can be simplified and the rebar tying machine 2 can be made compact as compared to a case where a rotary-type trigger lock is used.

Figure 7:
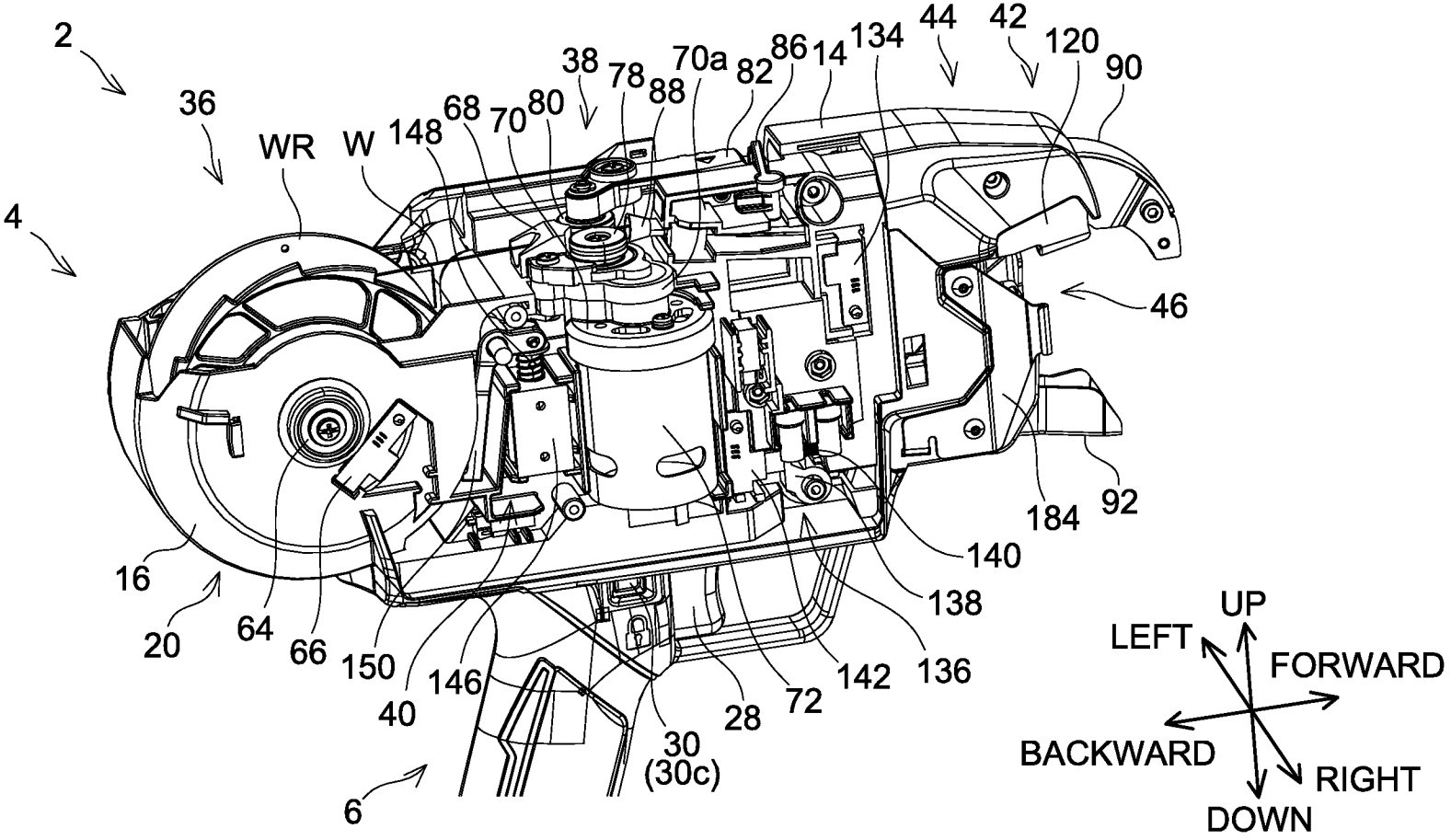
FIG. 7 is a perspective view seeing an internal structure of a tying machine body 4 of the rebar tying machine 2 according to the embodiment from the upper right rear side.
Figure 8:
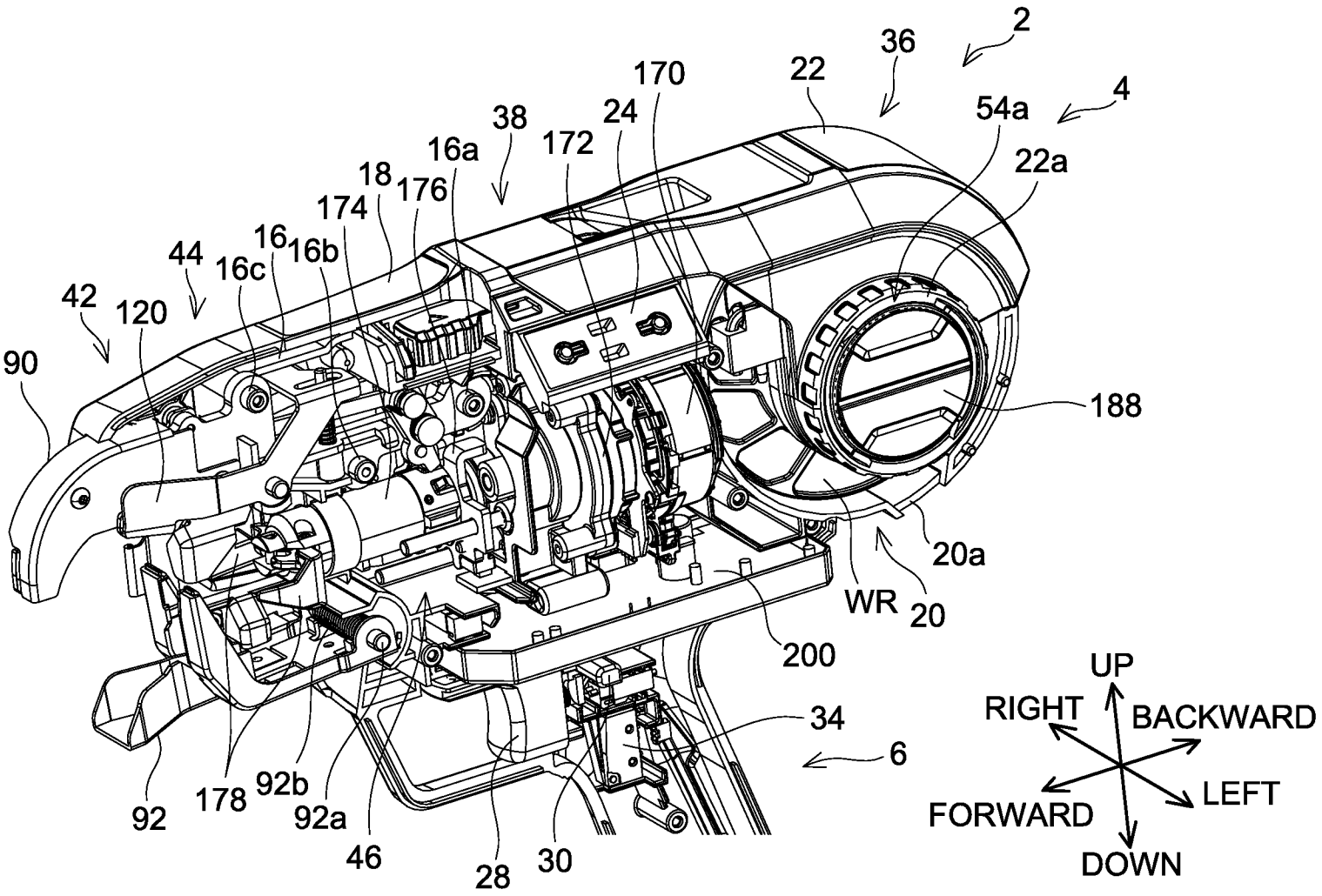
FIG. 8 is a perspective view seeing the internal structure of the tying machine body 4 of the rebar tying machine 2 according to the embodiment from an upper left front side.

As shown in FIGS. 7 and 8, the tying machine body 4 primarily includes a housing mechanism 36, a feed mechanism 38, a brake mechanism 40, a guide mechanism 42, a cutting mechanism 44, a twisting mechanism 46, and the control board 200.

As shown in FIG. 7, the housing mechanism 36 is disposed at the rear part of the tying machine body 4, and detachably retains the wire reel WR housed in the reel housing compartment 20. The wire reel WR is supported rotatably by the housing mechanism 36 in the reel housing compartment 20.

Figure 9:
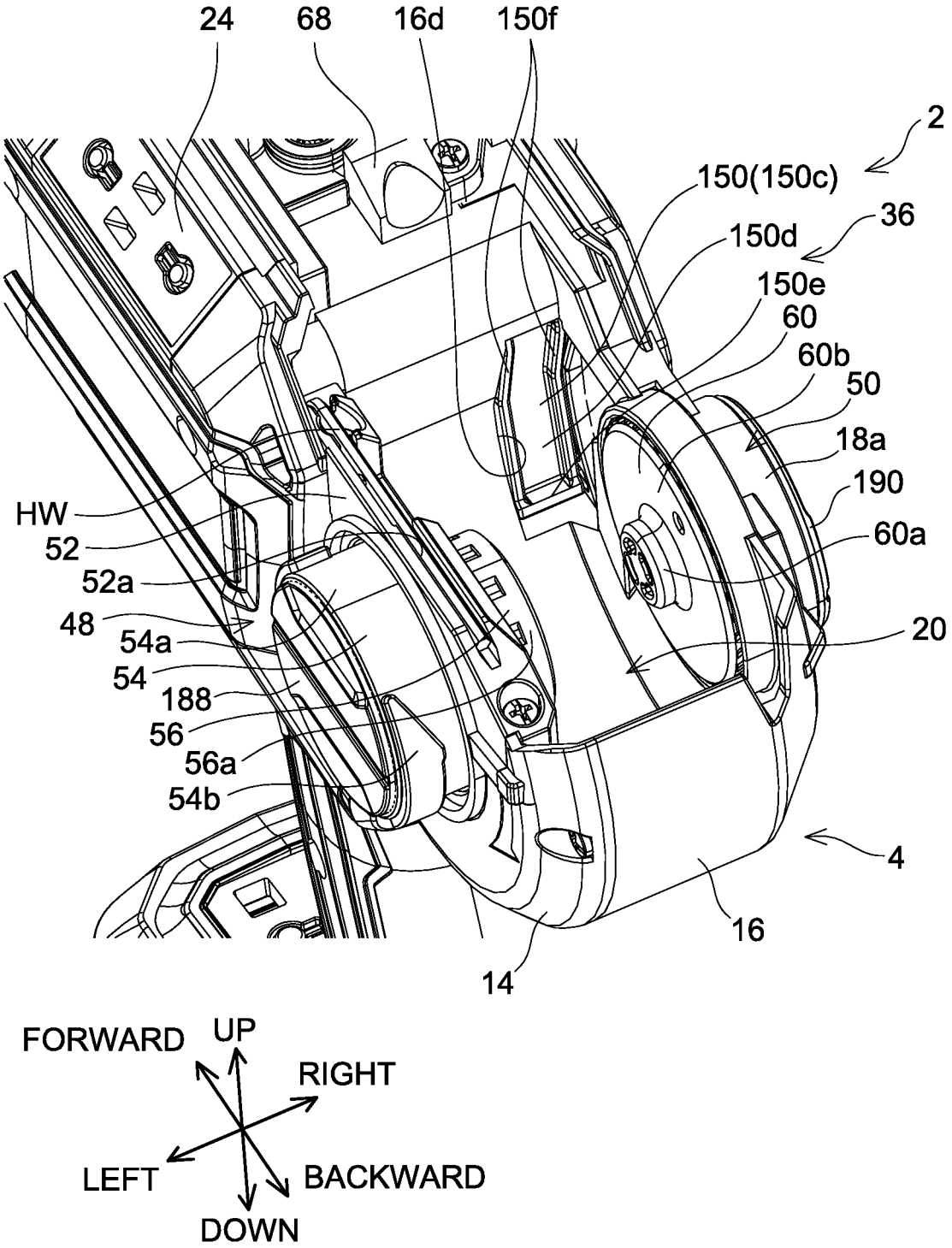
FIG. 9 is a perspective view seeing a reel housing compartment 20 of the rebar tying machine 2 according to the embodiment from the upper left rear side.
Figure 10:
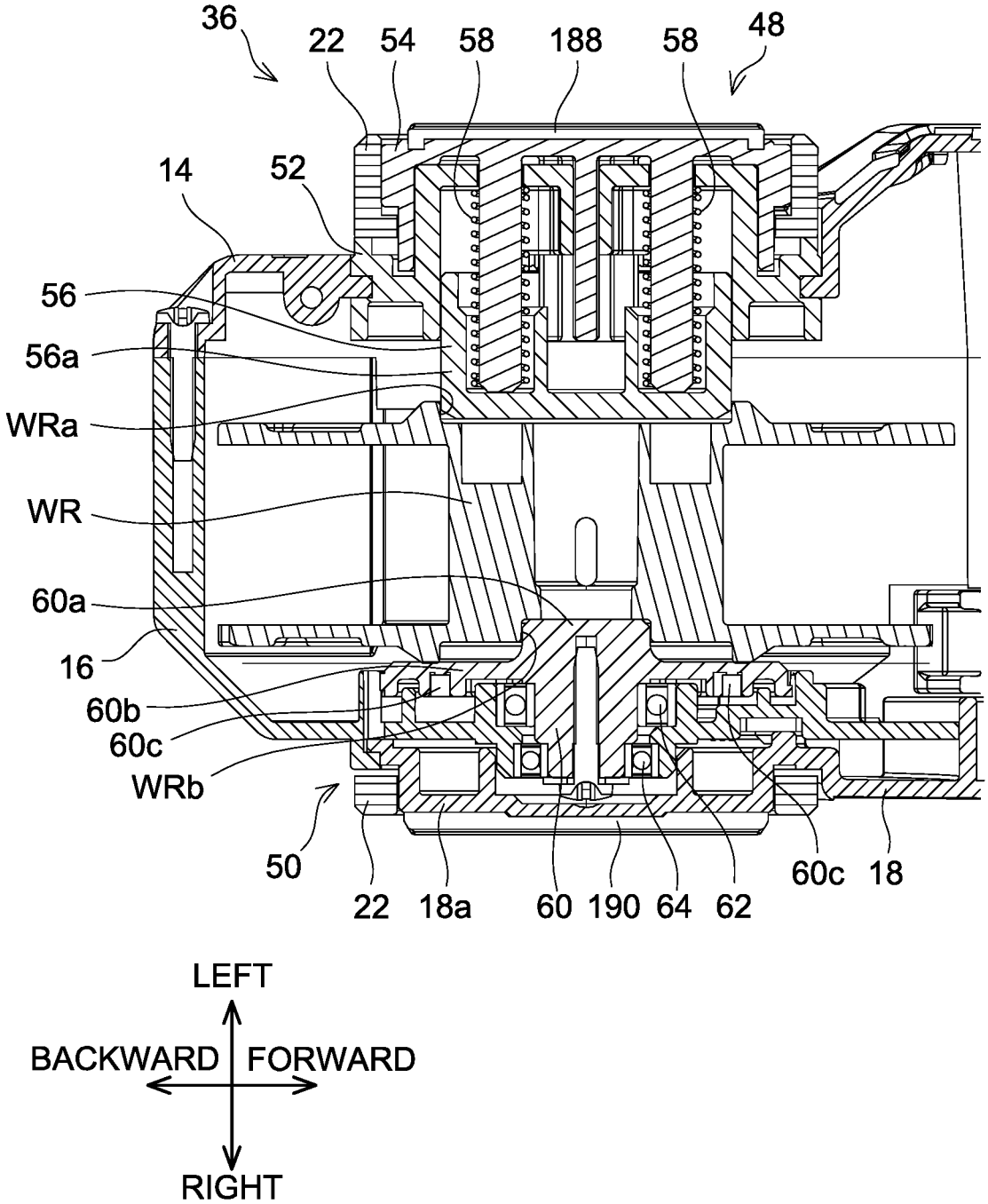
FIG. 10 is a cross-sectional view of a housing mechanism 36 of the rebar tying machine 2 according to the embodiment.

As shown in FIGS. 9 and 10, the housing mechanism 36 is provided with a left supporting mechanism 48 provided on a left side of the reel housing compartment 20 and a right supporting mechanism 50 provided on a right side of the reel housing compartment 20.

As shown in FIG. 10, the left supporting mechanism 48 includes a base member 52, a cam member 54, a shaft member 56, and a compression spring 58. The base member 52 is fixed to the left housing 14 with a plurality of screws. As shown in FIG. 9, an upper surface of the base member 52 is provided with a tool groove 52*a* configured to accept a tool that the user uses to perform maintenance on the rebar tying machine 2, such as a hexagonal wrench HW. As shown in FIG. 10, the cam member 54 is disposed to penetrate through the base member 52, and is retained by the base member 52 so as to be slidable in the left-and-right direction. The cam member 54 includes a cylindrical cover retainer 54*a* protruding outside the reel housing compartment 20. The cover retainer 54*a* retains the attaching portion 22*a* of the reel cover 22. The attaching portion 22*b* of the reel cover 22 is retained by a cylindrical cover retainer 18*a* provided on the side-surface cover housing 18. As shown in FIG. 9, a cam protrusion 54*b* is provided on an outer circumferential surface of the cover retainer 54*a*. Corresponding to the cam protrusion 54*b* of the cover retainer 54*a*, a cam protrusion, which is not shown, is provided on an inner circumferential surface of the attaching portion 22*a* of the reel cover 22. As shown in FIG. 10, the shaft member 56 includes a cylindrical reel retainer 56*a* protruding toward inside of the reel housing compartment 20. The shaft member 56 is fixed to the cam member 54 with a plurality of screws. Due to this, the shaft member 56 is slidable, together with the cam member 54, relative to the base member 52 in the left-and-right direction. Further, the shaft member 56 is biased in the right direction (that is, toward inside of the reel housing compartment 20) by the compression spring 58 retained by the base member 52. Under a normal state, the cam member 54 and the shaft member 56 are moved to the right side (that is, toward inside of the reel housing compartment 20) relative to the base member 52 by biasing force of the compression spring 58. In this state, the reel retainer 56*a* enters a shaft receiving groove WRa of the wire reel WR and the cam protrusion 54*b* of the cam member 54 presses the cam protrusion of the attaching portion 22*a* in a direction closing the reel cover 22, by which the reel cover 22 is closed. In this state, since the reel retainer 56*a* enters the shaft receiving groove WRa so as to be slidable relative to the shaft receiving groove WRa, the wire reel WR is retained rotatable relative to the reel retainer 56*a*. When the user opens the reel cover 22 against the biasing force of the compression spring 58 in this state, the cam protrusion of the attaching portion 22*a* of the reel cover 22 pushes the cam protrusion 54*b* of the cover retainer 54*a* in the left direction (that is, toward outside of the reel housing compartment 20) as the reel cover 22 rotates. Due to this, the cam member 54 and the shaft member 56 move to the left side (that is, toward outside of the reel housing compartment 20) relative to the base member 52, and the reel retainer 56*a* slides out of the shaft receiving groove WRa of the wire reel WR. In this state, the user can take out or put in the wire reel WR from or into the reel housing compartment 20.

Figure 11:
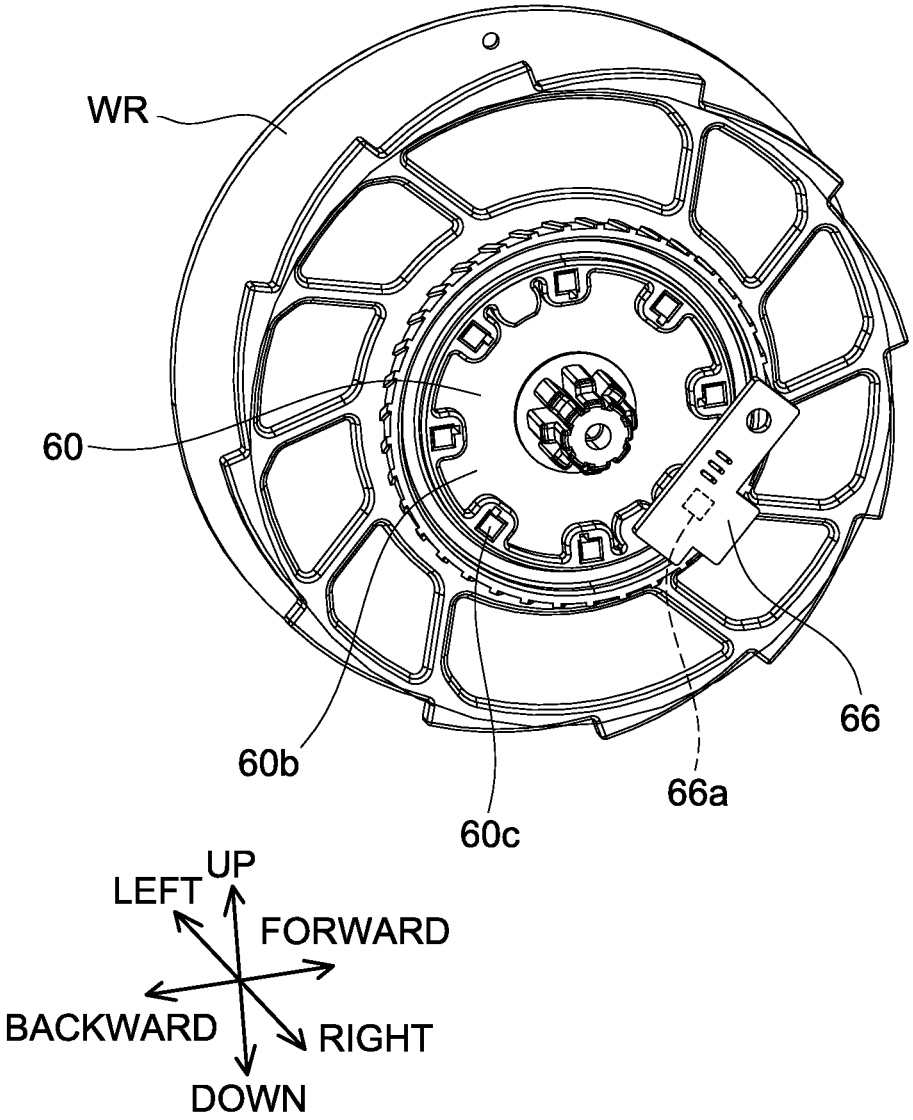
FIG. 11 is a perspective view seeing a wire reel WR, a turntable 60, and a magnetic sensor 66 of the rebar tying machine 2 according to the embodiment from the upper right rear side.
Figure 32:
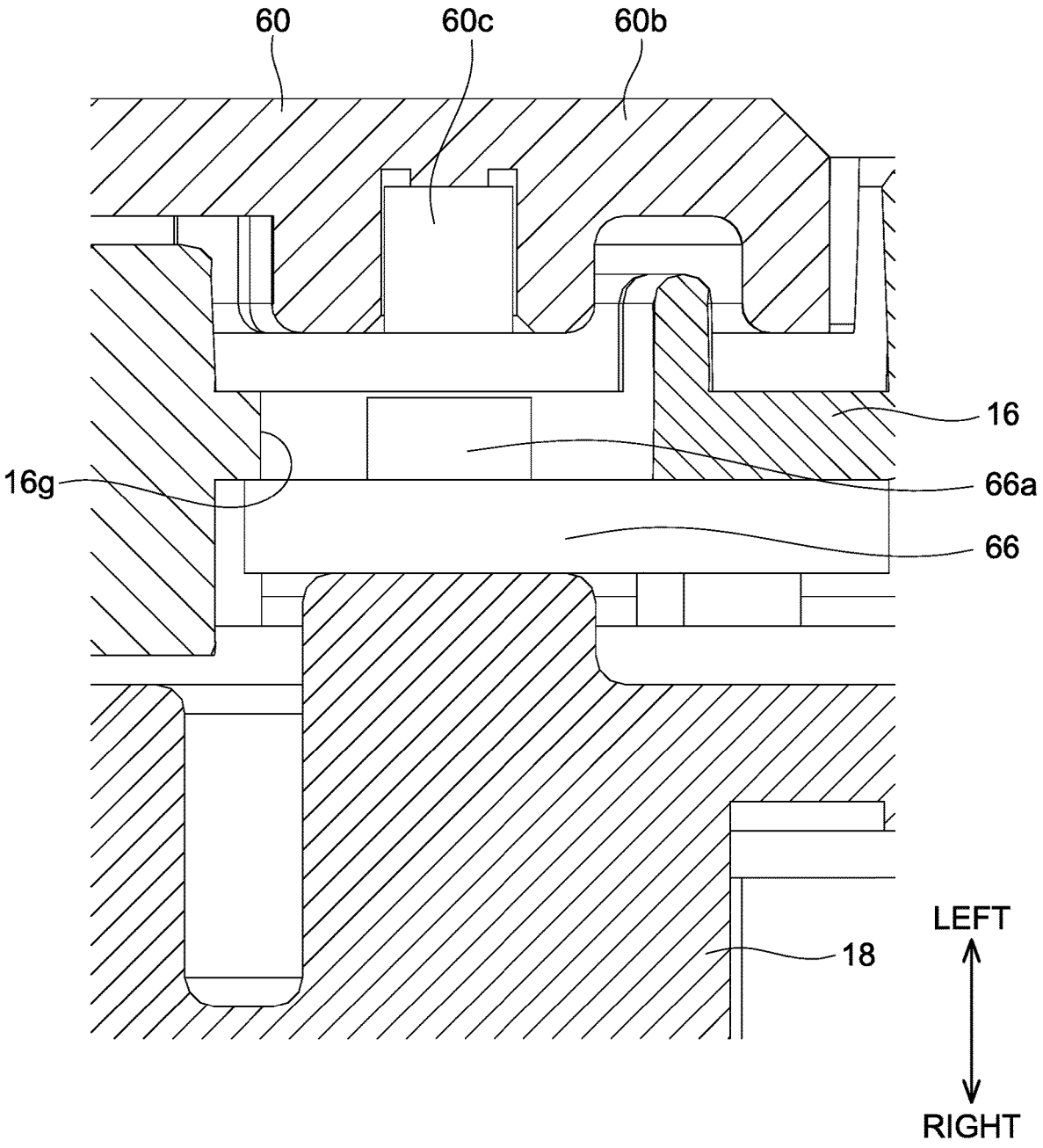
FIG. 32 is a cross-sectional view of the right housing 16, a side-surface cover housing 18, the turntable 60, and the magnetic sensor 66 of the rebar tying machine 2 according to the embodiment along a line XXXIII-XXXIII in FIG. 28.

As shown in FIG. 10, the right supporting mechanism 50 includes a turntable 60, an inner bearing 62, an outer bearing 64, and a magnetic sensor 66 (see FIG. 7). The turntable 60 is rotatably retained by the right housing 16 via the inner bearing 62 and the outer bearing 64. The turntable 60 includes a cylindrical reel retainer 60*a* protruding toward inside of the reel housing compartment 20 and a disk-shaped rotation detector 60*b* disposed along an inner side surface of the reel housing compartment 20. The reel retainer 60*a* engages with a shaft receiving groove WRb of the wire reel WR so as to be incapable of rotating relative thereto. Thus, when the wire reel WR rotates, the turntable 60 rotates together with the wire reel WR. As shown in FIG. 11, the rotation detector 60*b* has a plurality of sensor magnets 60*c* attached thereto at predetermined angle intervals. The sensor magnets 60*c* are constituted of magnets with strong magnetism, such as neodymium magnets. As shown in FIG. 7, the magnetic sensor 66 is disposed outside the right housing 16. The magnetic sensor 66 is electrically connected to the control board 200. As shown in FIGS. 28, 29, 30, and 31, the magnetic sensor 66 includes a Hall IC 66*a* and a through hole 66*b*. The right housing 16 includes a pin 16*e* protruding in a column shape from an outer surface of the right housing 16 at a position corresponding to the through hole 66*b* of the magnetic sensor 66, and a pair of interposing walls 16*f* disposed to interpose the magnetic sensor 66 therebetween with an interval smaller than a width of the magnetic sensor 66, and a through hole 16*g* provided at a position corresponding to the Hall IC 66*a* of the magnetic sensor 66. The magnetic sensor 66 is fitted to the right housing 16 by inserting the pin 16*e* of the right housing 16 into the through hole 66*b* and press-fitting the magnetic sensor 66 between the pair of interposing walls 16*f* of the right housing 16. In a state where the magnetic sensor 66 is attached to the right housing 16, the magnetic sensor 66 is disposed such that the Hall IC 66*a* faces one of the sensor magnets 60*c* through the through hole 16*g* of the right housing 16. As shown in FIG. 32, in a state where the side-surface cover housing 18 is attached to the right housing 16, the magnetic sensor 66 is interposed between the right housing 16 and the side-surface cover housing 18. When the wire reel WR rotates, the sensor magnets 60*c* of the turntable 60 rotate together with the wire reel WR, and magnetics detected by the Hall IC 66*a* thereby change. The control board 200 is configured to detect the rotation of the wire reel WR from the changes in the magnetics of the sensor magnets 60*c* detected by the Hall IC 66*a* of the magnetic sensor 66. In the rebar tying machine 2 of the present embodiment, the magnetic sensor 66 is attached to the right housing 16 that rotatably retains the turntable 60 via the inner bearing 62 and the outer bearing 64. With such a configuration, the sensor magnets 60*c* attached to the turntable 60 and the magnet sensor 66 can be positioned accurately.

Figure 12:
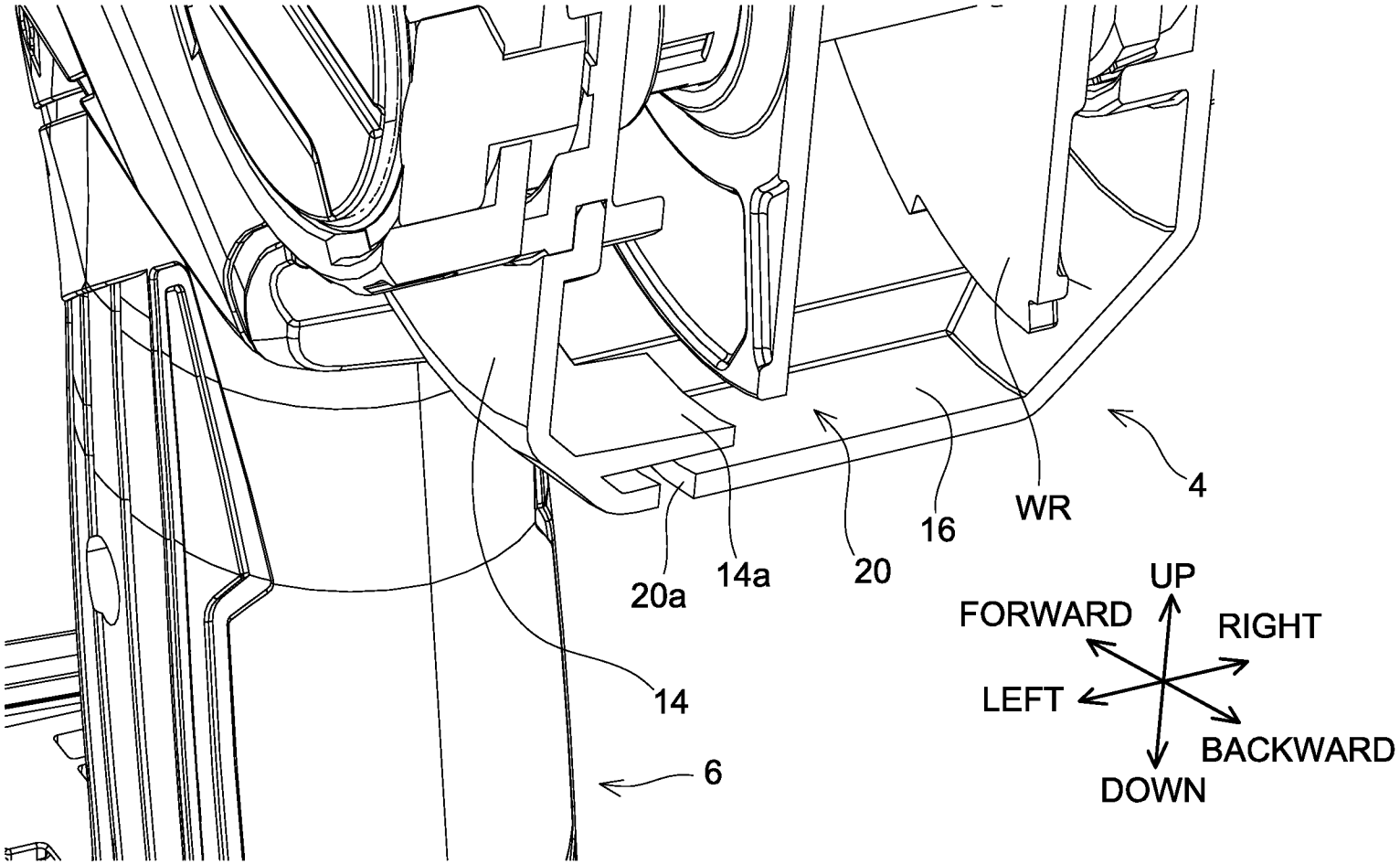
FIG. 12 is a perspective view seeing the reel housing compartment 20 of the rebar tying machine 2 according to the embodiment from the upper left rear side, and shows a vicinity of a water drainage hole 20*a* in cross section.

As shown in FIG. 3, a water drainage hole 20*a* is provided at a lowermost part of the reel housing compartment 20. With the water drainage hole 20*a* provided, water can be discharged to outside from inside of the reel housing compartment 20 even when water enters inside the reel housing compartment 20. The water drainage hole 20*a* is disposed at a position where the inside of the reel housing compartment 20 cannot be seen in the rear view of the rebar tying machine 2. Thus, the rotating wire reel WR is not exposed to a body of the user who stands behind the rebar tying machine 2, by which safety for the user can be ensured. Further, as shown in FIG. 12, the water drainage hole 20*a* has a so-called labyrinth structure in which the inside of the reel housing compartment 20 cannot be seen from the outside due to a partition wall 14*a* provided on the left housing 14. With such a configuration, foreign matters can be suppressed from entering inside the reel housing compartment 20 through the water drainage hole 20*a*.

Figure 13:
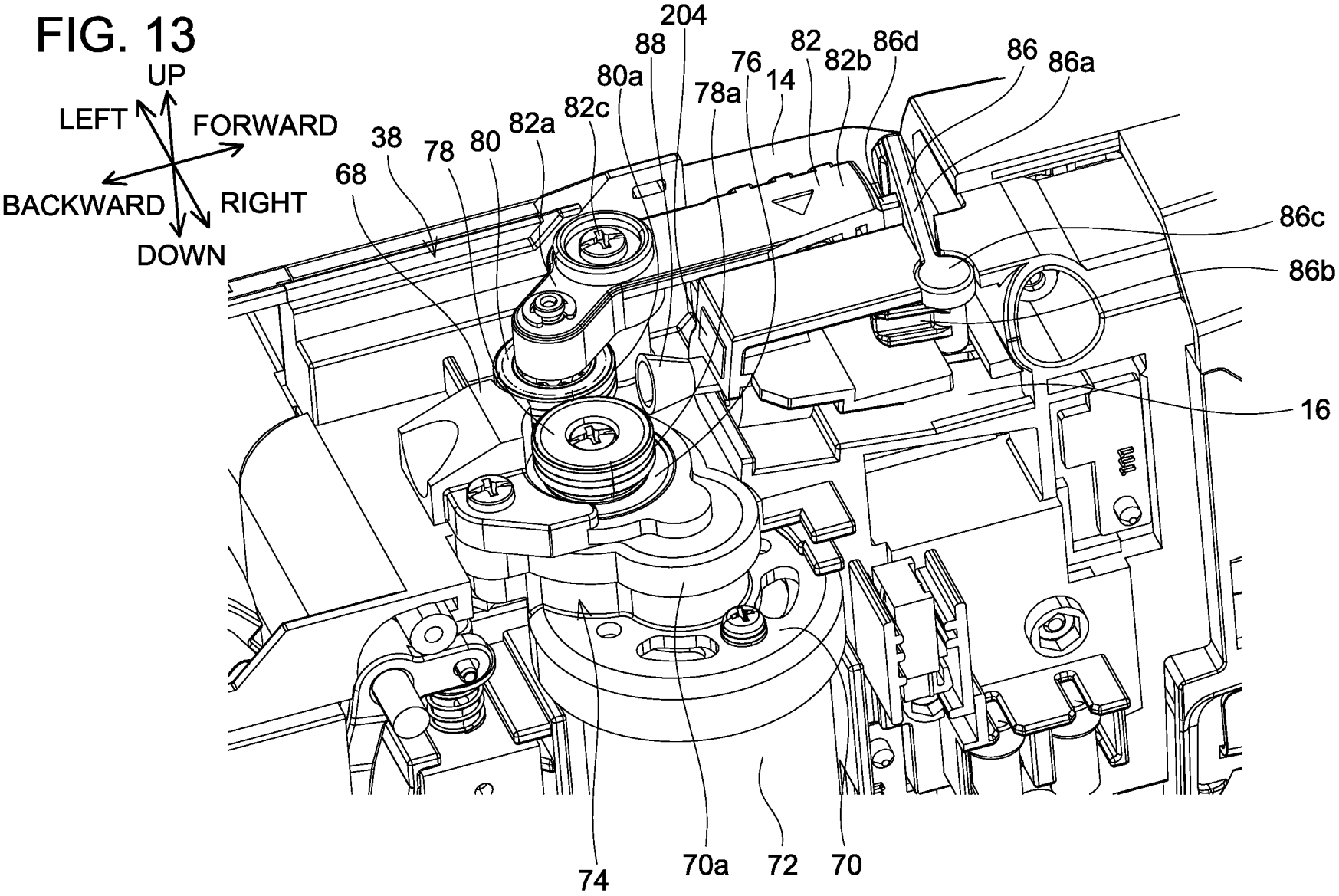
FIG. 13 is a perspective view seeing a feed mechanism 38 of the rebar tying machine 2 according to the embodiment from the upper right rear side.
Figure 14:
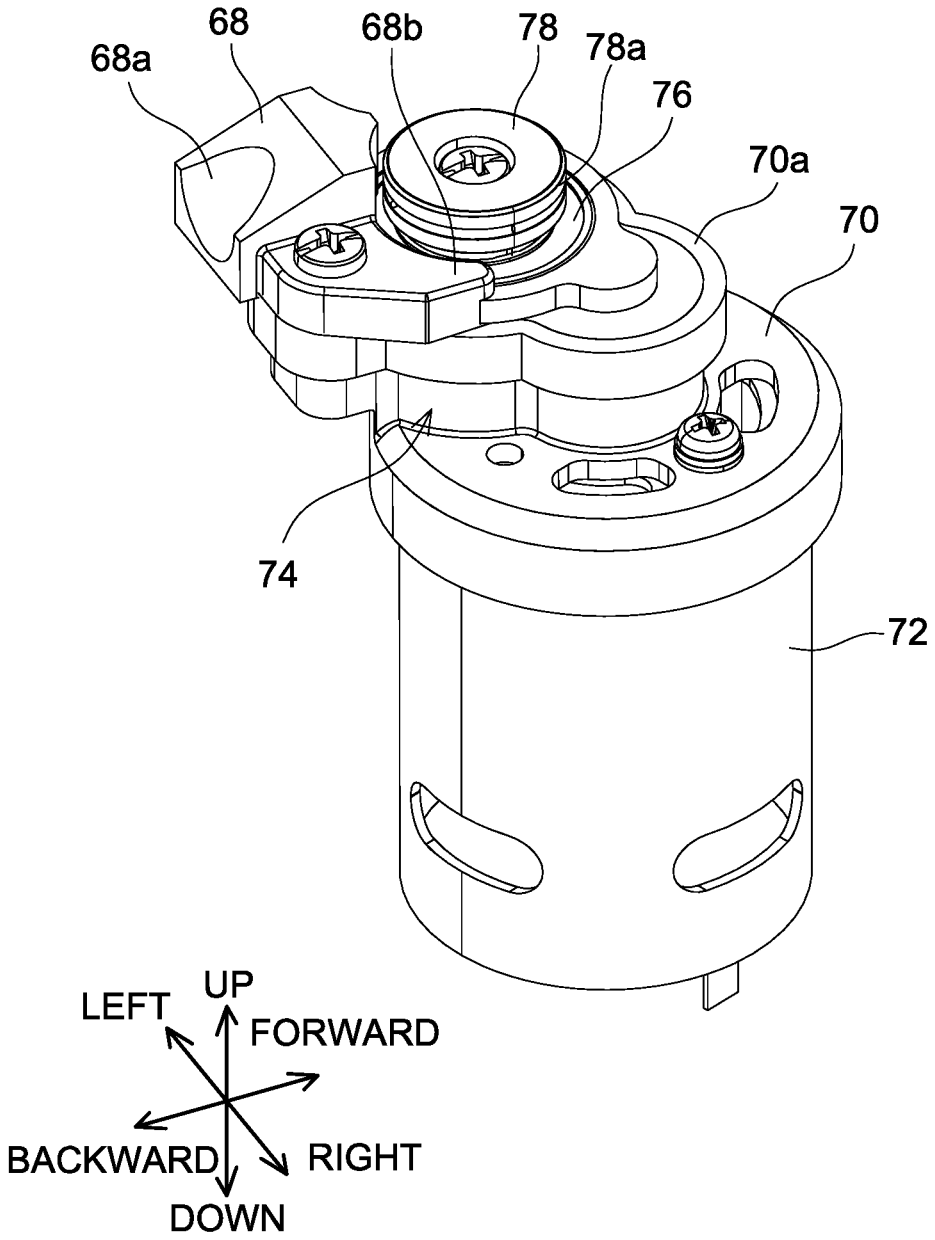
FIG. 14 is a perspective view seeing a guide member 68, a cover member 70, a feed motor 72, a reduction mechanism 74, a bearing 76, and a drive gear 78 of the rebar tying machine 2 according to the embodiment from the upper right rear side.
Figure 15:
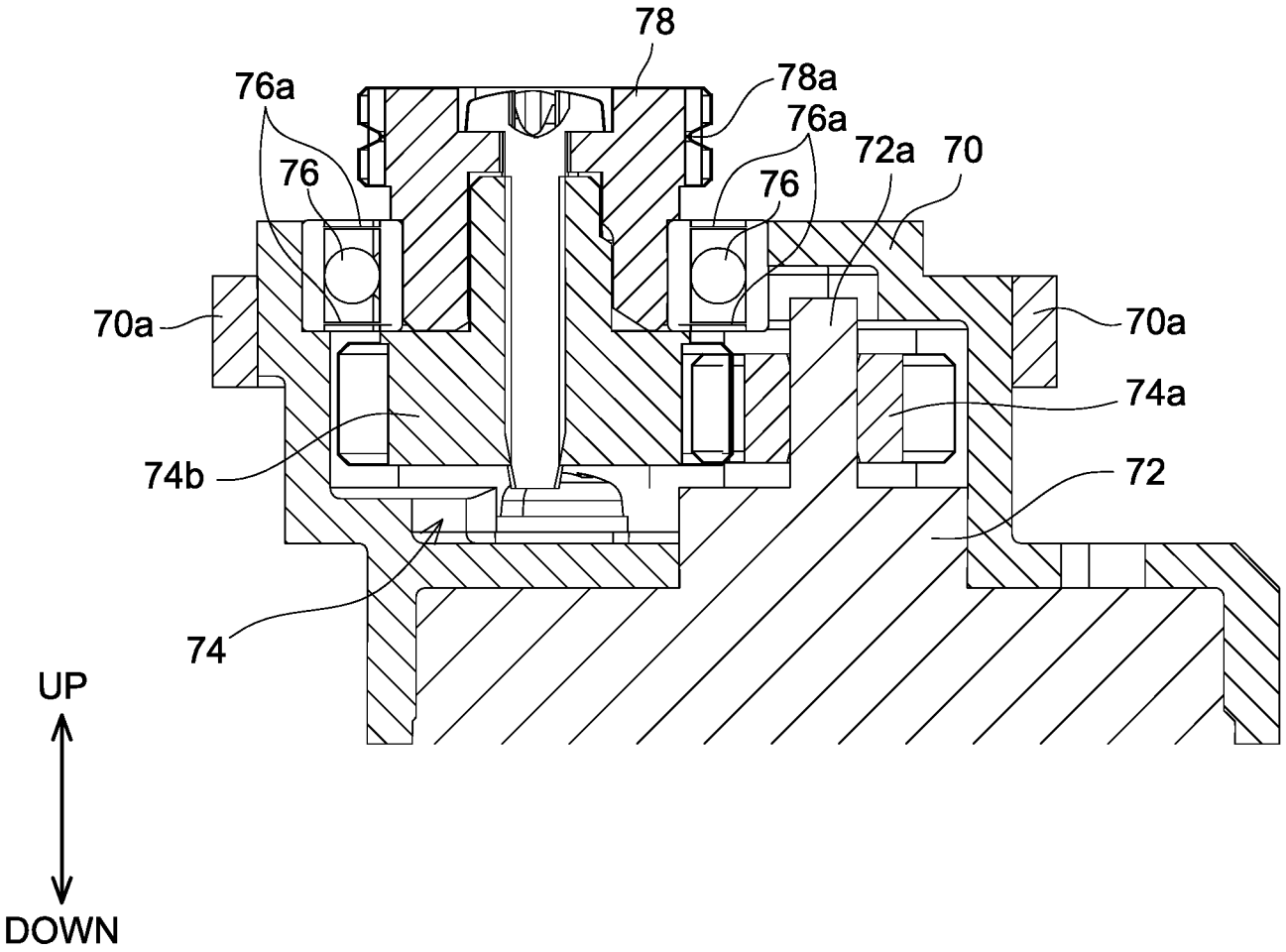
FIG. 15 is a cross-sectional view of the cover member 70, the feed motor 72, the reduction mechanism 74, the bearing 76, and the drive gear 78 of the rebar tying machine 2 according to the embodiment.

As shown in FIG. 7, the feed mechanism 38 is disposed at an upper part of the tying machine body 4 near its center in the front-and-rear direction, and is configured to feed out the wire W supplied from the wire reel WR of the housing mechanism 36 to the guide mechanism 42 at a front part of the tying machine body 4. As shown in FIG. 13, the feed mechanism 38 is provided with a guide member 68, a cover member 70, a feed motor 72, a reduction mechanism 74, a bearing 76, a drive gear 78, a driven gear 80, a release lever 82, a compression spring 84 (see FIG. 17), and a lock lever 86. As shown in FIGS. 14 and 15, the cover member 70, the feed motor 72, the reduction mechanism 74, the bearing 76, and the drive gear 78 are configured as a unit, and the unit is attached to the right housing 16 and the side-surface cover housing 18 in a state where the guide member 68 is further fixed to the cover member 70 by a screw. The cover member 70 is interposed between the right housing 16 and the side-surface cover housing 18 via a cushion member 70*a*. Thus, dust such as iron powder is suppressed from moving through a gap between the cover member 70 and the right housing 16 and a gap between the cover member 70 and the side-surface cover housing 18.

As shown in FIG. 15, a side surface of the drive gear 78 is provided with a V-shaped groove 78*a* extending in a circumferential direction of the drive gear 78 at its height-swise center. The drive gear 78 is coupled to the feed motor 72 via the reduction mechanism 74. The feed motor 72 is a direct current brush motor. The feed motor 72 is electrically connected to the control board 200. The control board 200 is configured to control an operation of the feed motor 72. The reduction mechanism 74 is provided with a spur gear 74*a* and a spur gear 74*b*. The spur gear 74*a* is fixed to an output shaft 72*a* of the feed motor 72. The spur gear 74*b* is fixed to the drive gear 78 by a screw. The cover member 70 is provided with a through hole through which the spur gear 74*b* and the drive gear 78 penetrate. The spur gear 74*b* and the drive gear 78 configure a rotation transmission mechanism configured to transmit rotation of the feed motor 72 to the drive gear 78 via the through hole of the cover member 70. The drive gear 78 is retained rotatably by the cover member 70 via the hearing 76. The bearing 76 is a dust-proof bearing, and is provided with a dust cover 76*a* that prevents dust such as iron powder from entering inside the bearing 76. The dust cover 76*a* may be a member integrated with the bearing 76, or may be a member separate from the bearing 76. The reduction mechanism 74 is housed in a space inside the cover member 70. That is, the reduction mechanism 74 is disposed on a feed motor 72 side as seen from the cover member 70, and is configured to reduce the rotation of the feed motor 72 and transmit the same to the drive gear 78. In the rebar tying machine 2, when the drive gear 78 feeds out the wire W, iron powder may be generated by the wire W being scraped. If this iron powder reaches the feed motor 72 and the reduction mechanism 74, it may adversely affect operations of the feed motor 72 and the reduction mechanism 74. According to the rebar tying machine 2 of the present embodiment, the bearing 76 attached in the through hole of the cover member 70 functions as a suppressing member that suppresses the iron powder from moving to the feed motor 72 side from a drive gear 78 side through the through hole. Due to this, the iron powder can be prevented from adversely affecting the feed motor 72 and the reduction mechanism 74.

Figure 16:
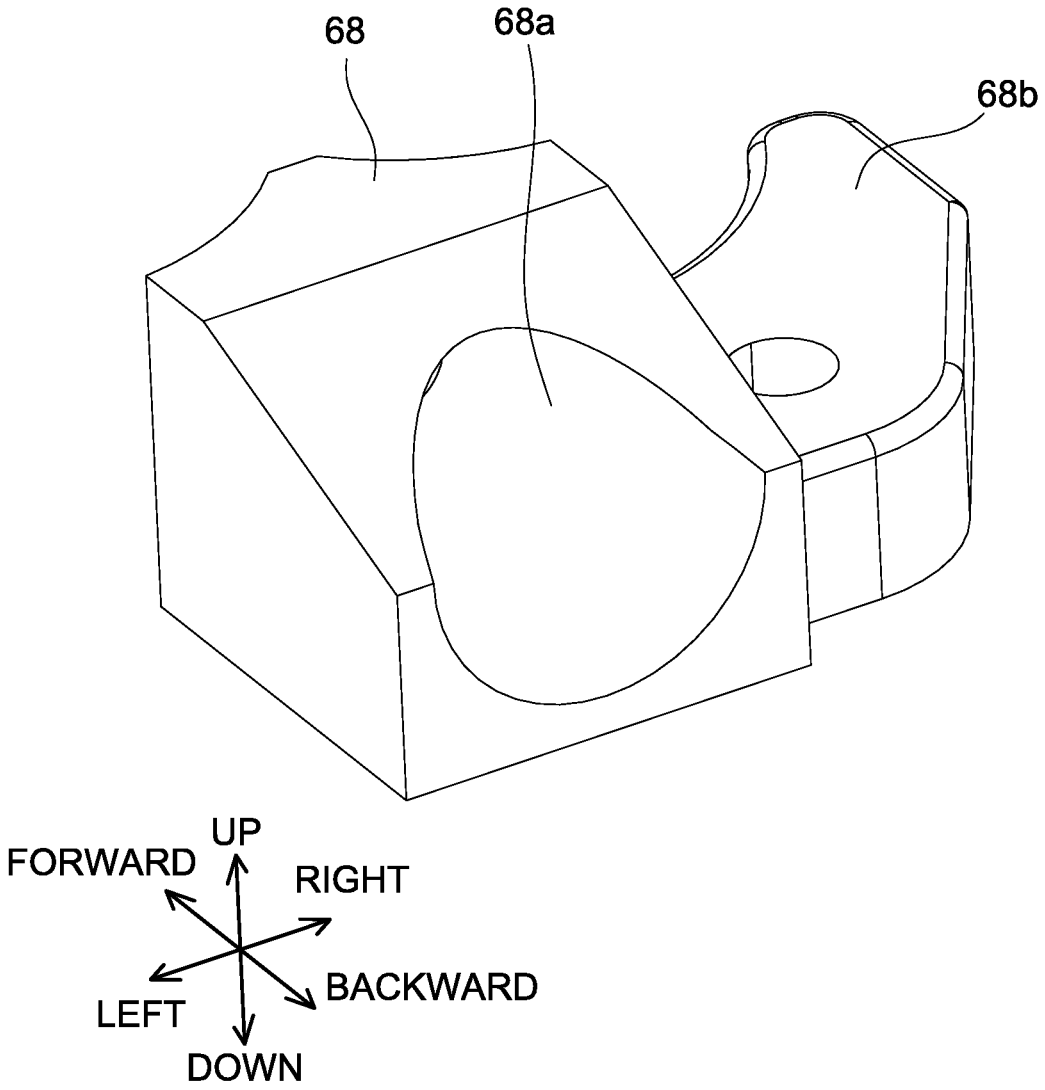
FIG. 16 is a perspective view seeing the guide member 68 of the rebar tying machine 2 according to the embodiment from the upper left rear side.

As shown in FIG. 16, the guide member 68 is provided with an insertion hole 68*a* for guiding the wire W drawn out from the wire reel WR toward the drive gear 78 and the driven gear 80. The insertion hole 68*a* has a shape in which a cone having a large diameter on an inlet side and a small diameter on an outlet side is cut obliquely. Due to this, an inlet of the insertion hole 68*a* of the guide member 68 opens to both upper and rear sides. Since the inlet of the insertion hole 68*a* is open to the upper side, that is, the inlet of the insertion hole 68*a* is open to an opposite side from a cover member 70 side as seen from the guide member 68, when the user of the rebar tying machine 2 inserts the wire W drawn out from the wire reel WR to the insertion hole 68*a*, a tip end of the wire W can easily be inserted to the insertion hole 68*a*. Further, a stopper piece 68*b* is provided on the guide member 68. As shown in FIG. 14, when the guide member 68 is fixed to the cover member 70 by a screw, the stopper piece 68*b* of the guide member 68 is disposed to partially cover an upper surface of the bearing 76. By providing the stopper piece 68*b* on the guide member 68, the guide member 68 can be used as a stopper for preventing the bearing 76 from being detached from the cover member 70.

Figure 17:
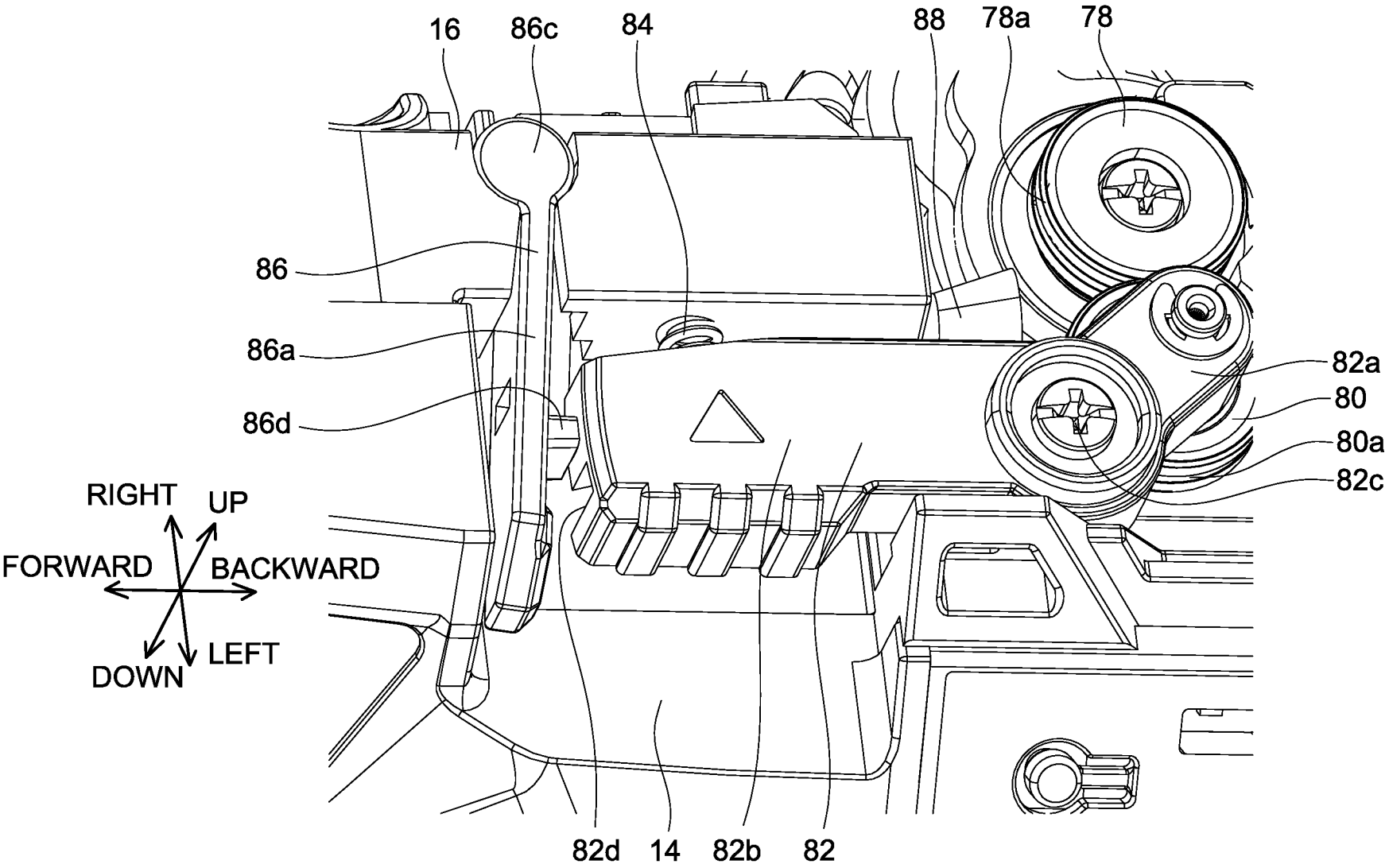
FIG. 17 is a perspective view seeing a release lever 82 and a lock lever 86 of the rebar tying machine 2 according to the embodiment from the upper left front side.

As shown in FIG. 13, the driven gear 80 is rotatably supported by a gear arm 82*a* of the release lever 82. A side surface of the driven gear 80 is provided with a V-shaped groove 80*a* extending in a circumferential direction of the driven gear 80 at its heightswise center. The release lever 82 is a substantially L-shaped member provided with a gear arm 82*a* and a manipulation arm 82*b*. The release lever 82 is pivotably supported by the right housing 16 via a pivot shaft 82*c*. As shown in FIG. 17, the manipulation arm 82*b* of the release lever 82 is biased in the left direction, that is, outward by the compression spring 84 retained by the right housing 16. Under the normal state, torque in a direction bringing the driven gear 80 closer to the drive gear 78 is applied to the release lever 82 by biasing force of the compression spring 84, by which the driven gear 80 is pressed against the drive gear 78. Due to this, teeth on the side surface of the driven gear 80 and teeth on the side surface of the drive gear 78 mesh, and the wire W is interposed between the V-shaped groove 78*a* of the drive gear 78 and the V-shaped groove 80*a* of the driven gear 80. When the drive gear 78 is rotated by the feed motor 72 in this state, the driven gear 80 rotates in a reverse direction, the wire W interposed between the drive gear 78 and the driven gear 80 is fed out to the guide mechanism 42, and the wire W is drawn out from the wire reel WR. The drive gear 78 and the driven gear 80 may be regarded as a feeding roller configured to feed out the wire W.

As shown in FIG. 13, the lock lever 86 is a substantially L-shaped member provided with a lock arm 86*a* and a spring receiver arm 86*b*. The lock lever 86 is pivotably supported by the right housing 16 via a pivot shaft 86*c*. The spring receiver arm 86*b* of the lock lever 86 is biased in the right direction by a compression spring, which is not shown, retained by the right housing 16. By biasing force of this compression spring, torque in a direction bringing the lock arm 86*a* closer to the manipulation arm 82*b* of the release lever 82 is applied to the lock lever 86. As shown in FIG. 17, the lock arm 86*a* of the lock lever 86 is provided with an engaging protrusion 86*d*, and the manipulation arm 82*b* of the release lever 82 is provided with an engaging recess 82*d* configured to engage with the engaging protrusion 86*d*.

When the user of the rebar tying machine 2 pushes in the manipulation arm 82*b* against the biasing force of the compression spring 84, the release lever 82 pivots about the pivot shaft 82*c*, and the driven gear 80 separates away from the drive gear 78. At this occasion, when the manipulation arm 82*b* is pushed in to a position where the engaging recess 82*d* of the manipulation arm 82*b* faces the engaging protrusion 86*d* of the lock arm 86*a*, the lock lever 86 pivots about the pivot shaft 86*c*, and the engaging protrusion 86*d* of the lock arm 86*a* engages with the engaging recess 82*d* of the manipulation arm 82*b*. Due to this, the manipulation arm 82*b* is maintained in a state of being pushed in. When the wire W extending from the wire reel WR is to be set in the feed mechanism 38, the user pushes in the manipulation arm 82*b* to separate the driven gear 80 away from the drive gear 78, and places, in this state, the tip end of the wire W drawn out from the wire reel WR between the dive gear 78 and the driven gear 80 through the insertion hole 68*a* of the guide member 68. Further, when the user moves the lock arm 86*a* of the lock lever 86 in a direction separating away from the manipulation arm 82*b* against the biasing force of the compression spring, the engagement between the engaging protrusion 86*d* of the lock arm 86*a* and the engaging recess 82*d* of the manipulation arm 82*b* is released and the release lever 82 pivots about the pivot shaft 82*c* by the biasing force of the compression spring 84, by which the driven gear 80 engages with the drive gear 78 and the wire W is interposed between the V-shaped groove 78*a* of the drive gear 78 and the V-shaped groove 80*a* of the driven gear 80.

Figure 33:
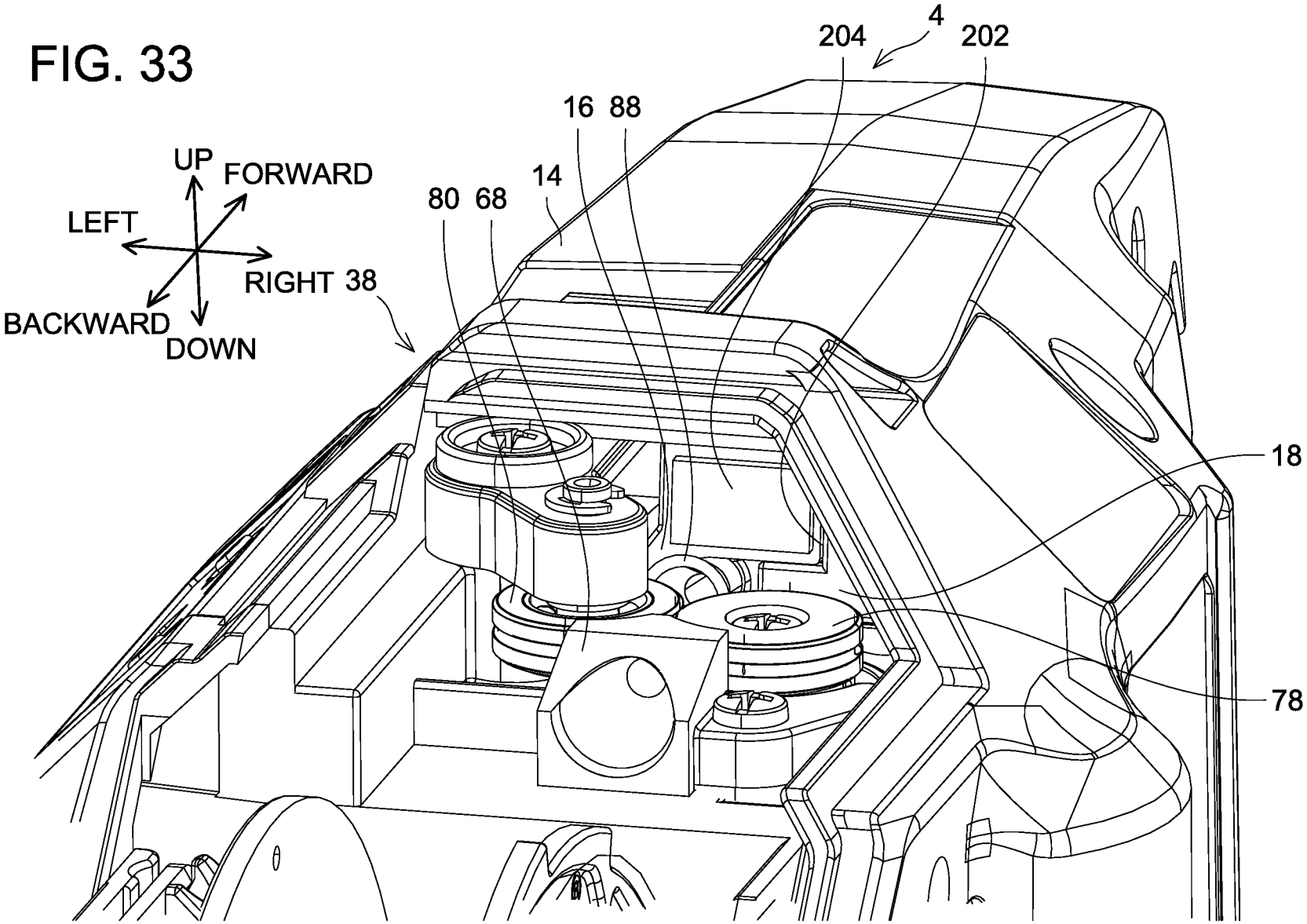
FIG. 33 is a perspective view seeing a structure near the drive gear 78 and a driven gear 80 of the rebar tying machine 2 according to the embodiment from the lower right rear side.

As shown in FIG. 33, an abutment portion 202 between the right housing 16 and the side-surface cover housing 18 is present near the drive gear 78 and the driven gear 80. This abutment portion 202 has a gap provided therein, and thus the abutment portion 202 can be regarded as a communication portion through which iron powder can move from outside to inside of the housing 12. When iron powder generated by the wire W being scraped upon when the wire W is fed out by the drive gear 78 and the driven gear 80 enters inside the housing 12 through the abutment portion 202, it may adversely affect operations of devices housed inside the housing 12. In the rebar tying machine 2 of the present embodiment, a collecting magnet 204 configured to collect the iron powder is attached to an outer wall surface of the right housing 16 near this abutment portion 202. The collecting magnet 204 is constituted of a magnet with weak magnetism such as a ferrite rubber magnet. According to this configuration, the iron powder generated by the wire W being scraped upon when the wire W is fed out by the drive gear 78 and the driven gear 80 is collected by the collecting magnet 204 before entering inside the housing 12. Due to this, the iron powder from the wire W can be suppressed from entering inside the housing 12 through the abutment portion 202.

Figure 20:
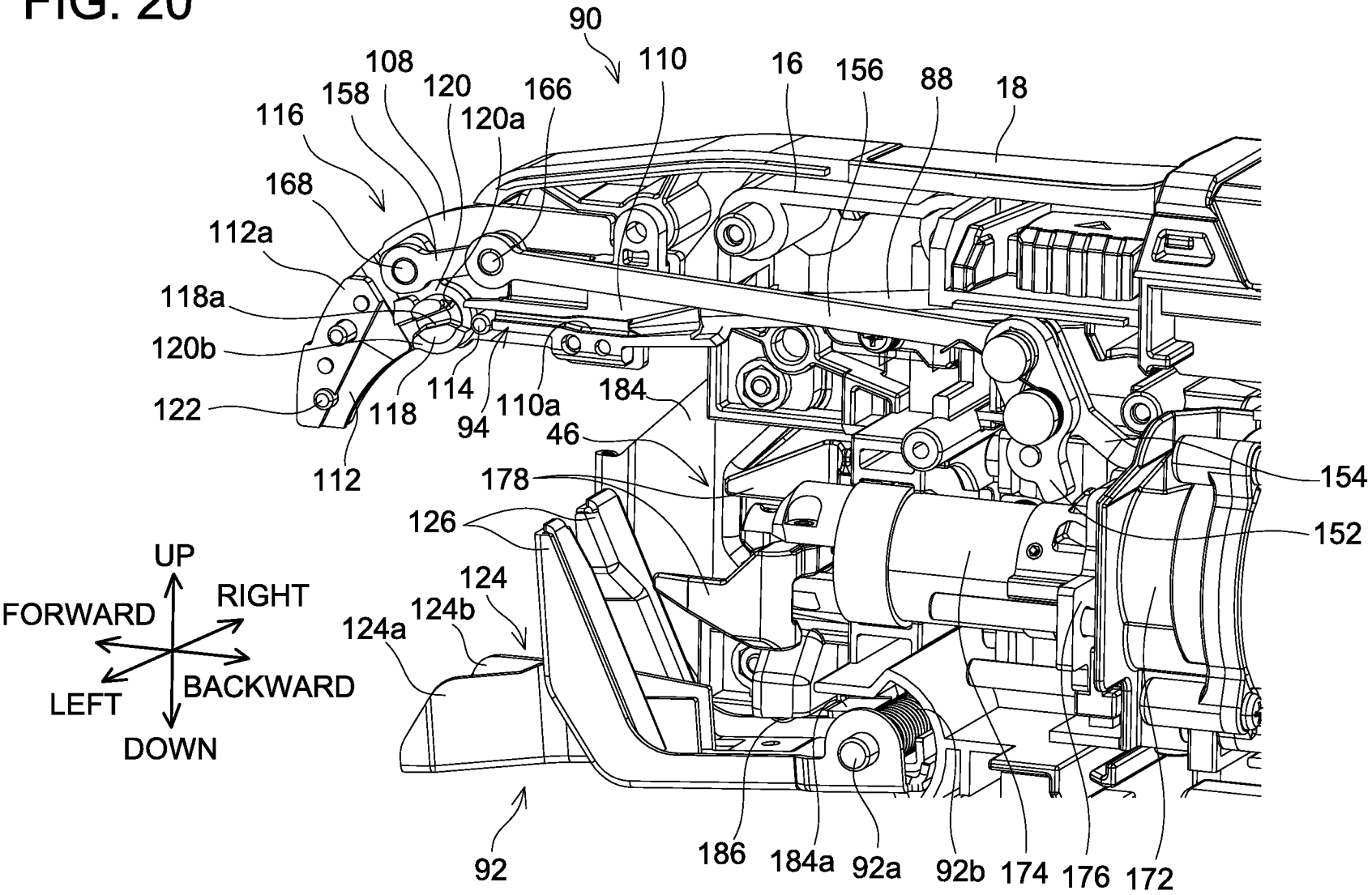
FIG. 20 is a perspective view seeing an internal structure of a first guiding passage 94 of the upper curl guide 90 and the internal structure of the tying machine body 4 of the rebar tying machine 2 according to the embodiment from the upper left rear side.

As shown in FIG. 8, the guide mechanism 42 is disposed at the front part of the tying machine body 4, and is configured to guide the wire W fed from the feed mechanism 38 in a loop shape around the plurality of rebars R (see FIG. 1). As shown in FIGS. 7 and 8, the guide mechanism 42 is provided with a guide pipe 88, an upper curl guide 90, and a lower curl guide 92. As shown in FIG. 13, a rear-side end of the guide pipe 88 is open toward a space between the drive gear 78 and the driven gear 80 of the feed mechanism 38. The wire W fed from the feed mechanism 38 is fed into the guide pipe 88. As shown in FIG. 20, a front-side end of the guide pipe 88 is open toward an inside of the upper curl guide 90. The upper curl guide 90 is provided with a first guiding passage 94 (see FIG. 20) for guiding the wire W fed from the guide pipe 88 and a second guiding passage 96 (see FIG. 21) for guiding the wire W fed from the lower curl guide 92.

Figure 18:
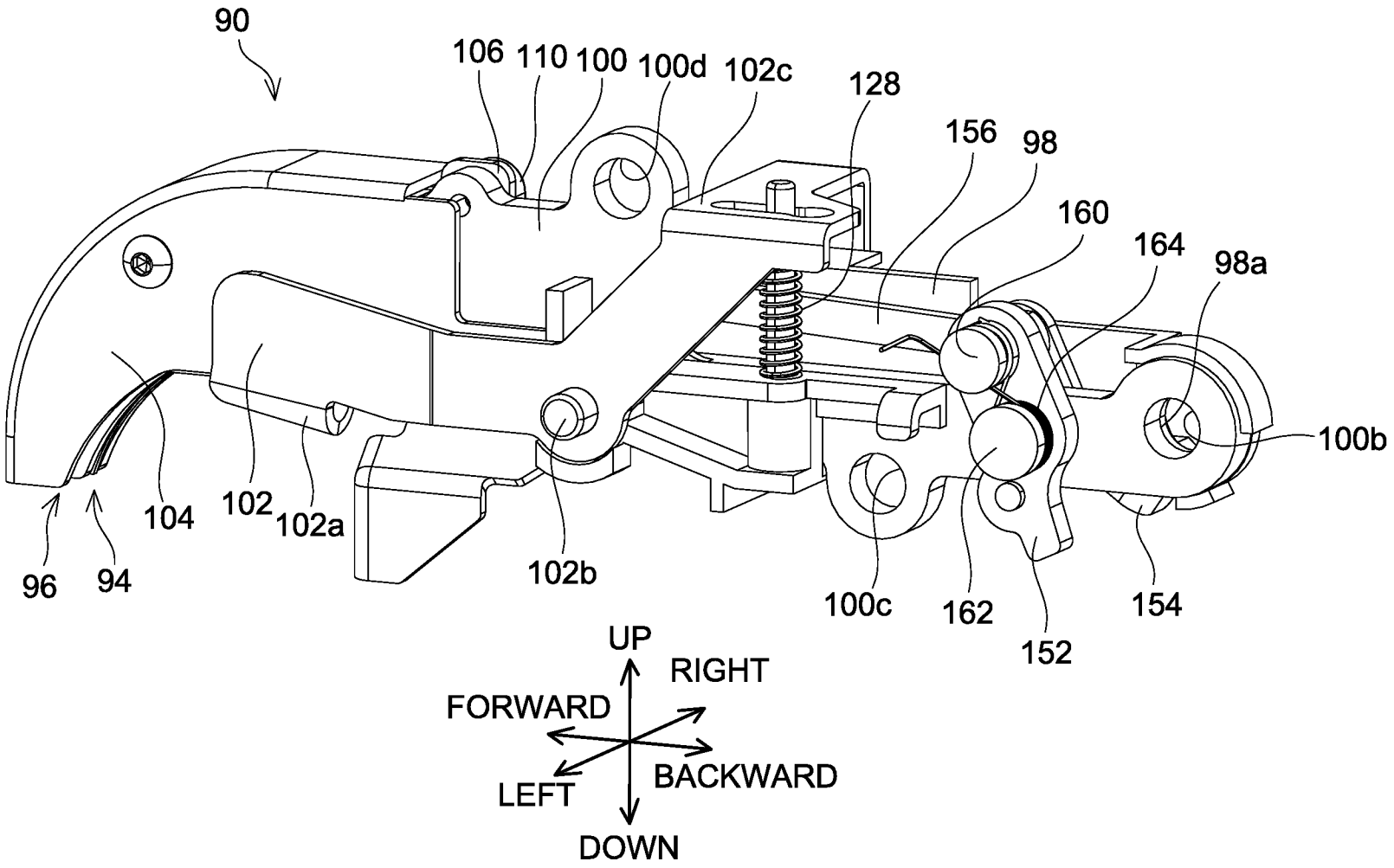
FIG. 18 is a perspective view seeing an upper curl guide 90 of the rebar tying machine 2 according to the embodiment from the upper left rear side.
Figure 19:
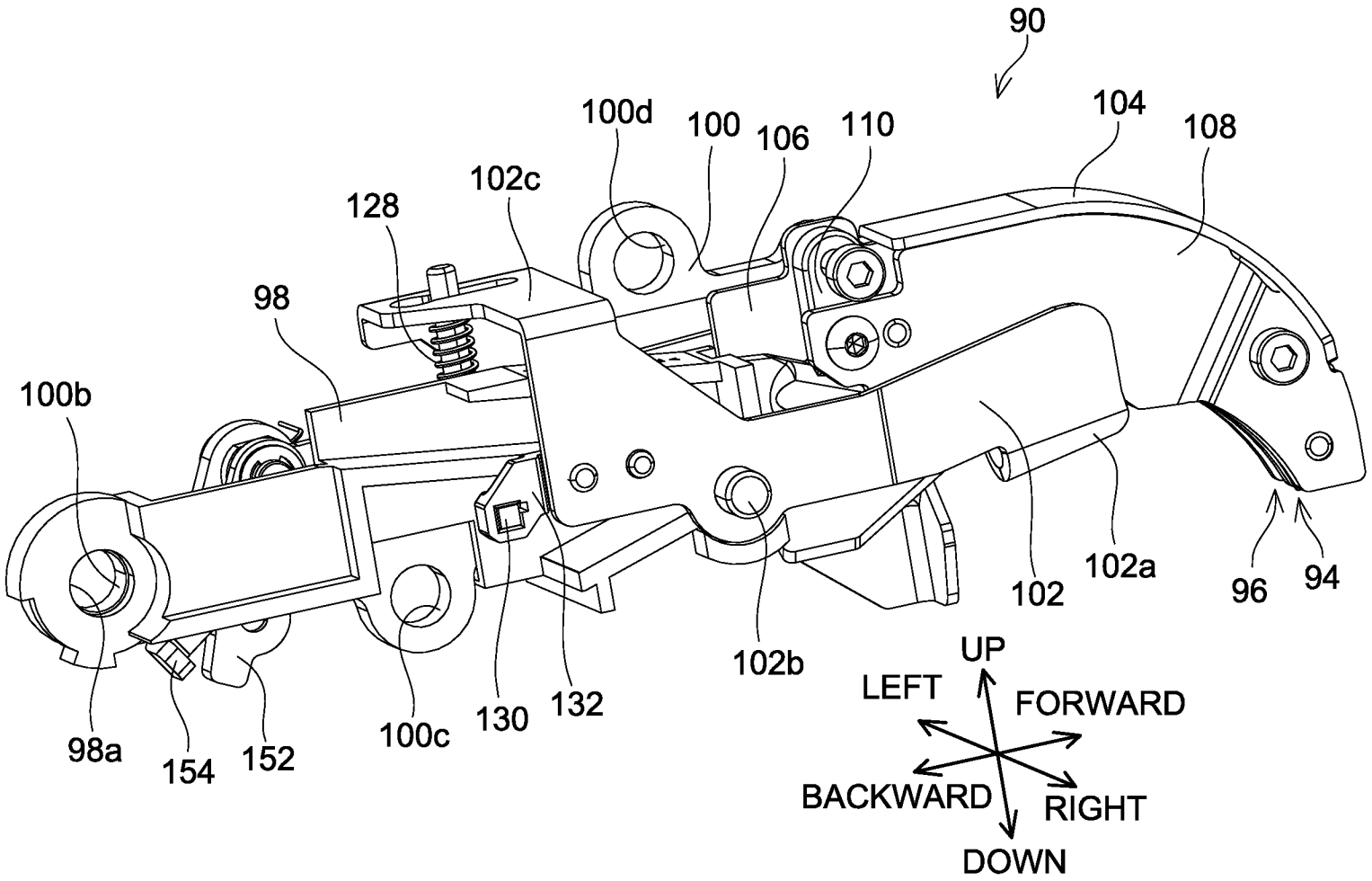
FIG. 19 is a perspective view seeing the upper curl guide 90 of the rebar tying machine 2 according to the embodiment from the upper right rear side.

As shown in FIGS. 18 and 19, the upper curl guide 90 is provided with a lead holder 98, a guide arm 100, a contact plate 102, a left guide plate 104, an inner guide plate 106, a right guide plate 108, a guide member 110 (see FIG. 20), and a top plate 112 (see FIG. 20).

The lead holder 98 retains the guide pipe 88 such that the front-side opening of the guide pipe 88 opens toward the first guiding passage 94 defined by the guide member 110, the right guide plate 108, the inner guide plate 106, and the top plate 112. As shown in FIG. 20, the guide member 110 is a metal member and is provided with a wire passage 110*a* through which the wire W passes therein. A first guide pin 114 is disposed at a lower front end of the wire passage 110*a*. The first guide pin 114 is a metal member having high wear resistance such as tungsten, and is press-fitted in the right guide plate 108. The wire W fed out from the guide pipe 88 is guided toward a cutter 116 by the wire passage 110*a* and the first guide pin 114.

The cutter 116 is provided with a fixing member 118 and a pivoting member 120. The fixing member 118 is a metal member having a cylindrical outer shape, and is provided with a wire passage 118*a* through which the wire W passes therein. The fixing member 118 is fitted with the inner guide plate 106 and is interposed by the right guide plate 108 and the inner guide plate 106. The pivoting member 120 is a metal member provided with a through hole 120*a* through which the fixing member 118 penetrates and a cutter piece 120*b* configured to cut the wire W. The pivoting member 120 is pivotably retained by the inner guide plate 106 and the right guide plate 108 via the fixing member 118. The cutter piece 120*b* is configured to shear the wire W when the pivoting member 120 pivots. The top plate 112 is a metal member and is fixed to the right guide plate 108. The wire W having passed the cutter 116 is further guided downward by a protrusion 112*a* of the top plate 112 and a second guide pin 122. The second guide pin. 122 is a metal member having high wear resistance such as tungsten, and is press-fitted in the right guide plate 108. While the wire W passes through the first guiding passage 94, it is given a curl by an inner upper surface of the wire passage 110*a*, the first guide pin 114, and the second guide pin 122, and then is fed toward the lower curl guide 92.

The lower curl guide 92 is provided with a third guiding passage 124 and a guard plate 126. The third guiding passage 124 is provided with a left guide wall 124*a* and a right guide wall 124*b* configured to guide the wire W fed from a front end of the upper curl guide 90. The guard plate 126 has a shape extending upward on both sides of the third guiding passage 124, and prevents the plurality of rebars R from interfering with the twisting mechanism 46 and foreign matters from entering inside of the tying machine body 4. Further, the guard plate 126 prevents the wire W from meandering to left and right when the twisting mechanism 46 twists the wire W wound in a loop shape. The wire W guided by the lower curl guide 92 is fed toward the second guiding passage 96 of the upper curl guide 90.

Figure 21:
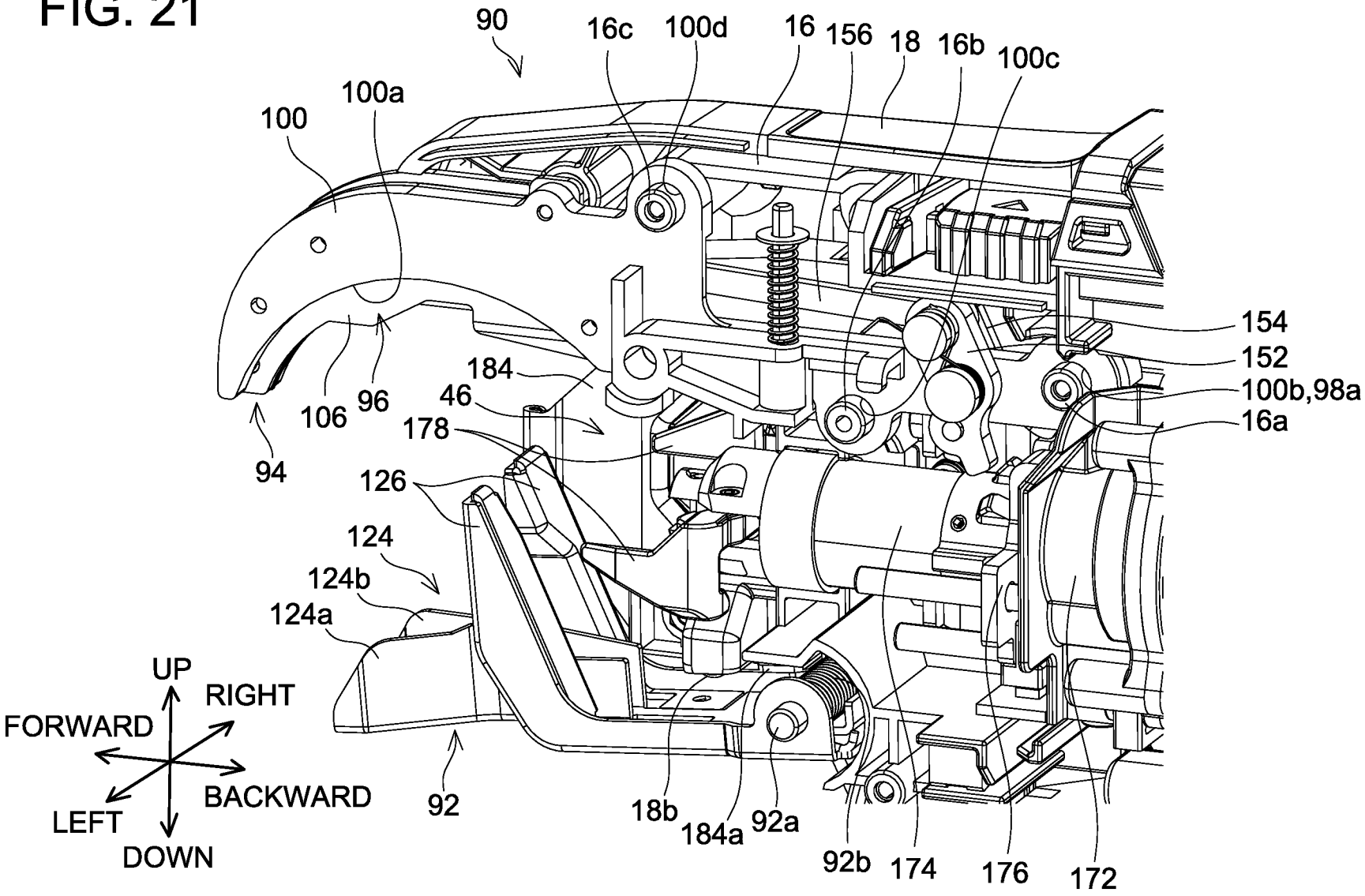
FIG. 21 is a perspective view seeing an internal structure of a second guiding passage 96 of the upper curl guide 90 and the internal structure of the tying machine body 4 of the rebar tying machine 2 according to the embodiment from the upper left rear side.

The wire W fed from a rear side of the lower curl guide 92 to a rear side of the upper curl guide 90 is fed into the second guiding passage 96 defined by the guide arm 100, the left guide plate 104, and the inner guide plate 106. As shown in FIG. 21, an arc-shaped upper guide wall 100*a* configured to guide the wire W is provided on a lower front surface of the guide arm 100. The wire W fed from the lower curl guide 92 to the upper curl guide 90 is guided by the second guiding passage 96 and is again fed from a front side of the upper curl guide 90 toward a front side of the lower curl guide 92.

As shown in FIGS. 18 and 19, the contact plate 102 is a substantially U-shaped member and is disposed to traverse the lead holder 98 and the guide arm 100. The contact plate 102 is provided with a contact portion 102*a*, a pivot shaft 102*b*, and a connecting portion 102*c*. The contact plate 102 is pivotably supported by the lead holder 98 via the pivot shaft 102*b*. The connecting portion 102*c* of the contact plate 102 is biased upward by a compression spring 128 retained by the lead holder 98. As shown in FIG. 19, the contact plate 102 is provided with a magnet arm 132 on which a sensor magnet 130 is attached. The sensor magnet 130 is constituted of a magnet with strong magnetism such as a neodymium magnet. As shown in FIG. 7, a magnetic sensor 134 is attached to the right housing 16 in the front part of the tying machine body 4. The magnetic sensor 134 is electrically connected to the control board 200. Under the normal state, the sensor magnet 130 of the contact plate 102 is disposed at a position facing the magnetic sensor 134. When the rebar tying machine 2 is set with respect to the plurality of rebars R by the user and the plurality of rebars R is pressed against the contact portion 102*a*, the contact plate 102 pivots against biasing force of the compression spring 128 and the sensor magnet 130 of the magnet arm 132 moves to a position offset from the magnetic sensor 134. The control board 200 is configured to detect whether or not the plurality rebars R is pressed against the contact portion 102*a* from a detection signal of the magnetic sensor 134.

As shown in FIG. 19, the lead holder 98 is provided with one attachment hole 98*a*. As shown in FIG. 18, the guide arm 100 is provided with three attachment holes 100*b*, 100*c*, 100*d*. The attachment hole 98*a* of the lead holder 98 and one attachment hole 100*b* of the guide arm 100 are disposed to overlap each other. As shown in FIG. 8, screw bosses 16*a*, 16*b*, 16*c* used for attaching the left housing 14 to the right housing 16 are provided in the right housing 16 in the front part of the tying machine body 4. The upper curl guide 90 is attached to the right housing 16 by fitting the attachment hole 98*a* of the lead holder 98 and the attachment hole 100*b* of the guide arm 100 to the screw boss 16*a*, fitting the attachment hole 100*c* of the guide arm 100 to the screw boss 16*b*, and fitting the attachment hole 100*d* of the guide arm 100 to the screw boss 16*c*. By attaching the upper curl guide 90 to the right housing 16 by using the screw bosses 16*a*, 16*b*, 16*c* used for attaching the left housing 14 to the right housing 16, the upper curl guide 90 can be attached to the right housing 16 without increasing a number of components. Further, the upper curl guide 90 can accurately be positioned with respect to the right housing 16. Further, since portions where the screw bosses 16*a*, 16*b*, 16*c* are provided have relatively high strength within the right housing 16, high durability can be ensured even when load generated by collision with the plurality of rebars R is transmitted from the upper curl guide 90 to the right housing 16. A number of portions where the upper curl guide 90 is attached to the right housing 16 may be any number so long as it is two or more. Among them, a number of the portion(s) where the upper curl guide 90 is attached by using the screw boss(es) for attaching the left housing 14 to the right housing 16 may be one or two, or may be four or more. By providing two or more portions where the upper curl guide 90 is attached by using the screw bosses, the upper curl guide 90 can accurately be positioned with respect to the right housing 16. Further, higher durability can be ensured with a larger number of the portions where the upper curl guide 90 is attached by using the screw bosses.

As shown in FIG. 8, the lower curl guide 92 is pivotably supported by the left housing 14 and the right housing 16 via a pivot shaft 92*a*. The lower curl guide 92 is pivotable between a closed state shown in FIG. 22 and an opened state shown in FIG. 23. As shown in FIG. 8, the lower curl guide 92 is biased in its closing direction by a torsion spring 92*b*. When the user uses the rebar tying machine 2, the lower curl guide 92 is in the closed state. In a case where the wire W is tangled in the twisting mechanism 46 while the user is using the rebar tying machine 2, the user can open the lower curl guide 92 against biasing force of the torsion spring 92*b* to remove the tangled wire W in the twisting mechanism 46.

Figure 22:
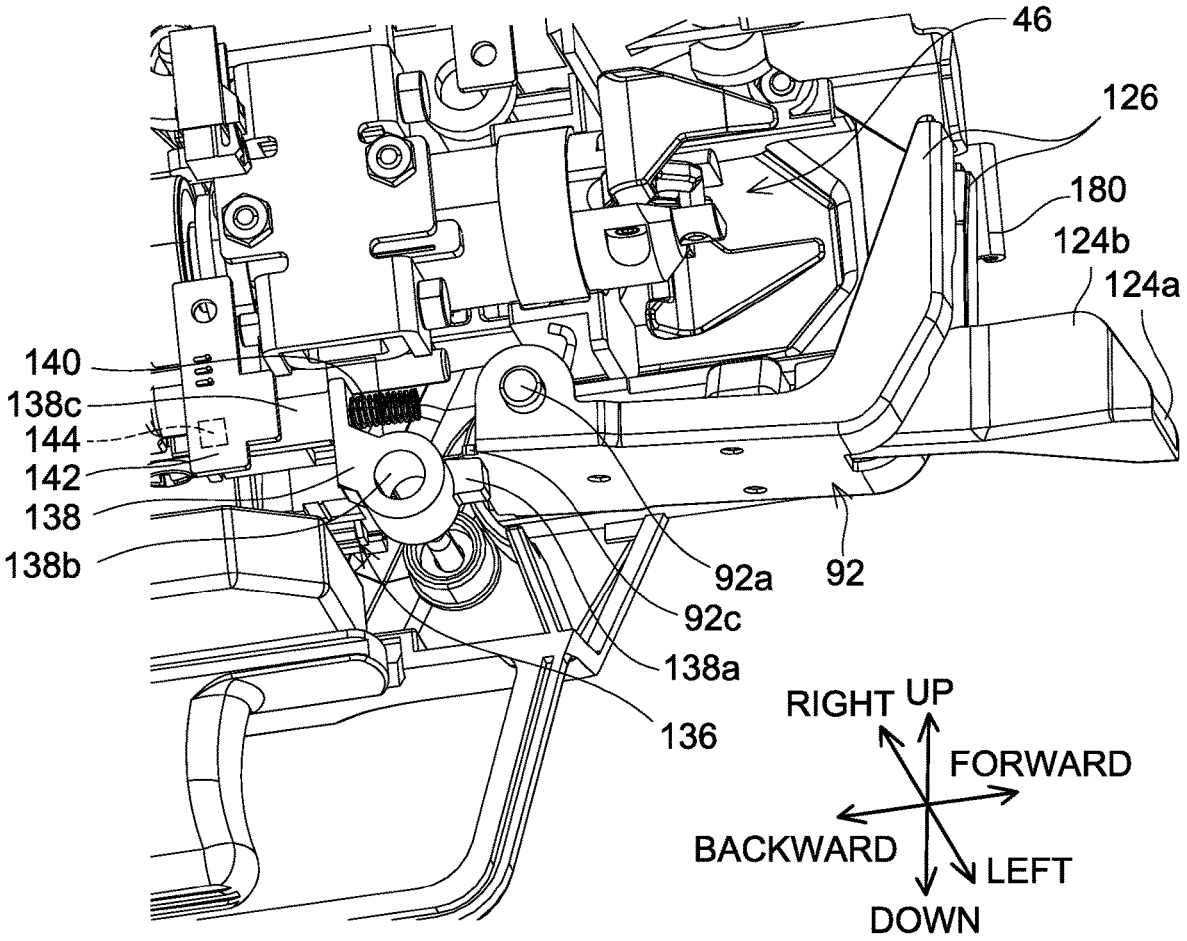
FIG. 22 is a perspective view seeing the internal structure of the tying machine body 4 from a lower right front side when a lower curl guide 92 is closed in the rebar tying machine 2 according to the embodiment.
Figure 23:
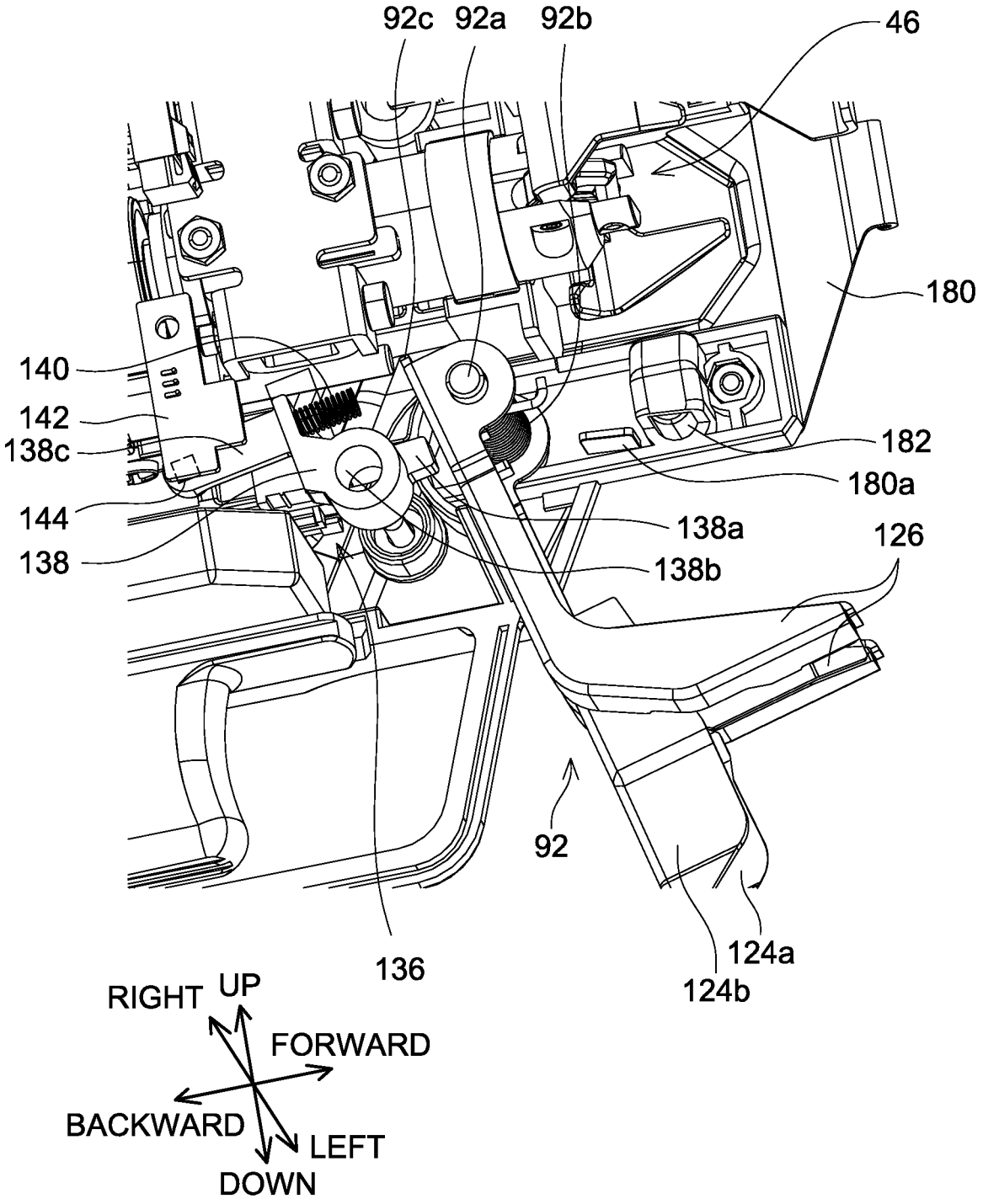
FIG. 23 is a perspective view seeing the internal structure of the tying machine body 4 from the lower right front side when the lower curl guide 92 is open in the rebar tying machine 2 according to the embodiment.

As shown in FIGS. 22 and 23, an open/close detection mechanism 136 configured to detect the opened and closed states of the lower curl guide 92 is provided at a lower front part of the tying machine body 4. The open/close detection mechanism 136 is attached to the right housing 16. The open/close detection mechanism 136 is provided with an open/close detection member 138, a compression spring 140, and a magnetic sensor 142. The open/close detection member 138 is provided with a contact arm 138*a* and a support arm 138*c*. The open/close detection member 138 is pivotably supported by the right housing 16 via a pivot shaft 138*b*. Further, the open/close detection member 138 is biased in a pivoting direction along which the contact arm 138*a* moves upward by the compression spring 140 retained by the right housing 16. A sensor magnet 144 (see FIG. 23) is attached to the support arm 138*c* of the open/close detection member 138. The sensor magnet 144 is constituted of a magnet with strong magnetism such as a neodymium magnet. The magnetic sensor 142 is fixed to the right housing 16. The magnetic sensor 142 is electrically connected to the control board 200. A contact portion 92*c* protruding rearward is provided at a lower rear part of the lower curl guide 92. As shown in FIG. 22, in the state where the lower curl guide 92 is closed by the biasing force of the torsion spring 92*b*, the contact portion 92*c* of the lower curl guide 92 is pressing down the contact arm 138*a* of the open/close detection member 138, and the sensor magnet 144 of the support arm 138*c* is disposed at a position facing the magnetic sensor 142. As shown in FIG. 23, when the user opens the lower curl guide 92 against the biasing force of the torsion spring 92*b*, the contact portion 92*c* of the lower curl guide 92 separates away from the contact arm 138*a* of the open/close detection member 138. Due to this, the open/close detection member 138 pivots by biasing force of the compression spring 140, and the sensor magnet 144 of the support arm 138*c* is moved to a position offset from the magnetic sensor 142. The control board 200 is configured to detect the opened and closed states of the lower curl guide 92 from a detection signal of the magnetic sensor 142. As shown in FIG. 23, a rigid stopper 180*a* and an elastic stopper 182 extending from a metal side plate 180 attached to the left housing 14 are provided on the left housing 14 near the lower curl guide 92. The elastic stopper 182 may be constituted of, for example, an elastic material such as an urethane pin, a rubber pin, or elastomer. Further, as shown in FIGS. 20 and 21, a rigid stopper 184*a* and an elastic stopper 186 extending from a metal side plate 184 attached to the right housing 16 are provided on the right housing 16 near the lower curl guide 92. The elastic stopper 186 may be constituted of, for example, an elastic material such as an urethane pin, a rubber pin, or elastomer. When the lower curl guide 92 is closed as shown in FIG. 22 from its opened state as shown in FIG. 23, the lower curl guide 92 firstly contacts with the elastic stoppers 182, 186, and thereafter contacts with the rigid stoppers 180*a*, 184*a*. With such a configuration, even when the lower curl guide 92 is closed with strong force, generation of a large colliding sound can be suppressed.

Figure 34:
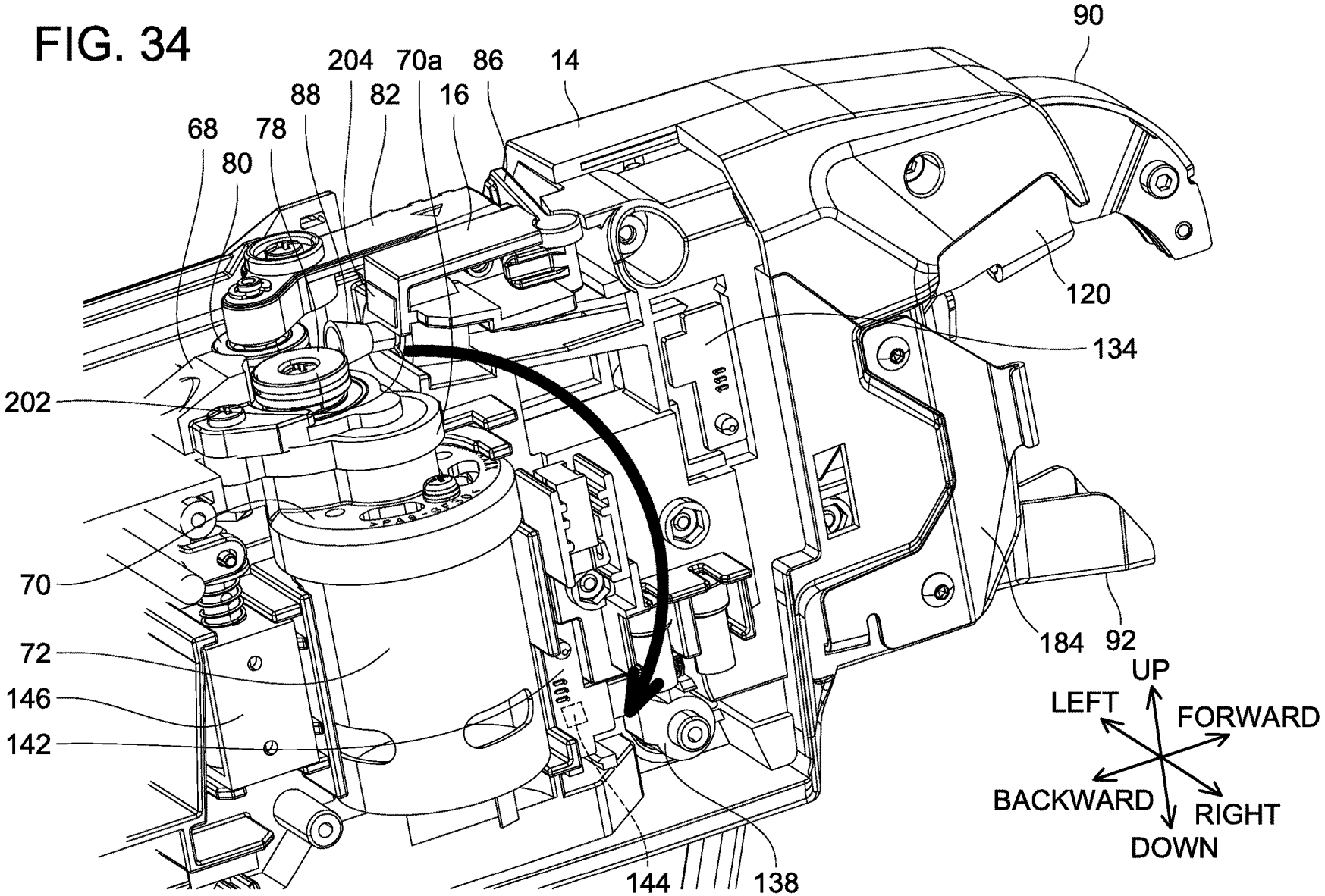
FIG. 34 is a view explaining an example of a path along which iron powder that entered inside a housing 12 moves in the rebar tying machine 2 according to the embodiment.
Figure 35:
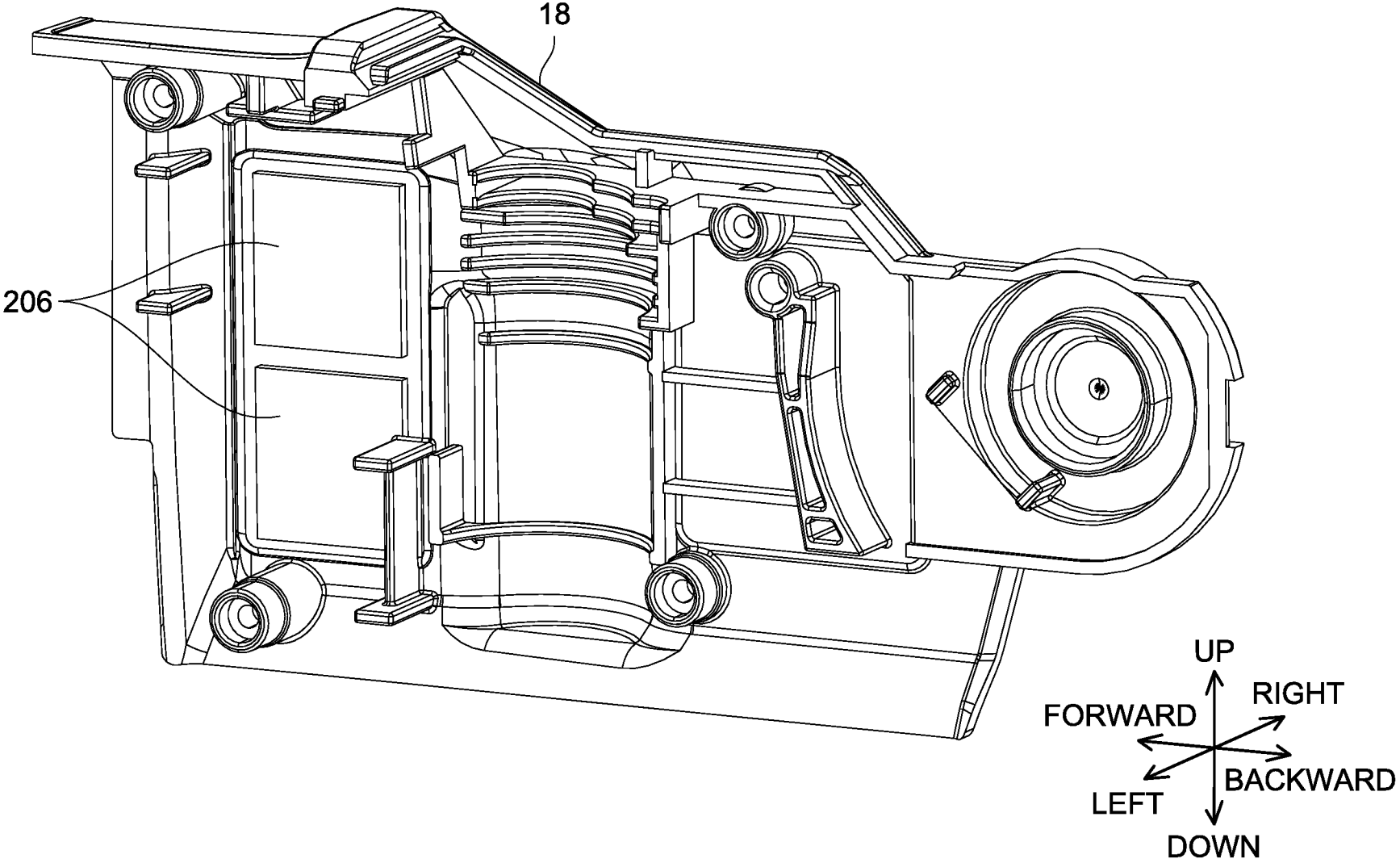
FIG. 35 is a perspective view seeing the side-surface cover housing 18 of the rebar tying machine 2 according to the embodiment from the upper left rear side.

As shown in FIG. 34, iron powder generated by the wire W being scraped when the drive gear 78 and the driven gear 80 of the feed mechanism 38 feed out the wire W may enter inside the housing 12 through the abutment portion 202 between the right housing 16 and the side-surface cover housing 18. In this case, as shown in FIG. 34 by an arrow, the iron powder having entered inside the housing 12 may move downward from above in the housing 12, and may reach the sensor magnet 144 of the open/close detection member 138 (see FIG. 23). If the iron powder reaches the sensor magnet 144, there is a possibility that the open/close detection of the lower curl guide 92 by the magnetic sensor 142 may be adversely affected. As such, as shown in FIG. 35, the rebar tying machine 2 of the present embodiment has a collecting magnet 206 configured to collect the iron powder attached to an inner wall surface of the side-surface cover housing 18. The collecting magnet 206 is constituted of a magnet with weak magnetism such as a ferrite rubber magnet. The collecting magnet 206 is disposed inside the housing 12 on a path along which the iron powder moves from the abutment portion 202 to the sensor magnet 144 (which is a path shown by the arrow in FIG. 34). According to this configuration, the iron powder having entered inside the housing 12 through the abutment portion 202 is collected by the collecting magnet 206 before reaching the sensor magnet 144. Due to this, the iron powder having entered inside the housing 12 can be suppressed from adversely affecting an operation of the open/close detection mechanism 136.

As shown in FIG. 1, the upper curl guide 90 feeds out the wire W downward from an upper front side of the rebars R, and the lower curl guide 92 feeds out the wire W, which has been fed from the upper curl guide 90, upward from a lower rear side of the rebars R. Due to this, the wire W fed from the feed mechanism 38 is wound in a loop shape around the rebars R. The feed mechanism 38 stops the feed motor 72 and stops feeding the wire W when the wire W has been fed out by a feed amount thereof set by the user.

Figure 24:
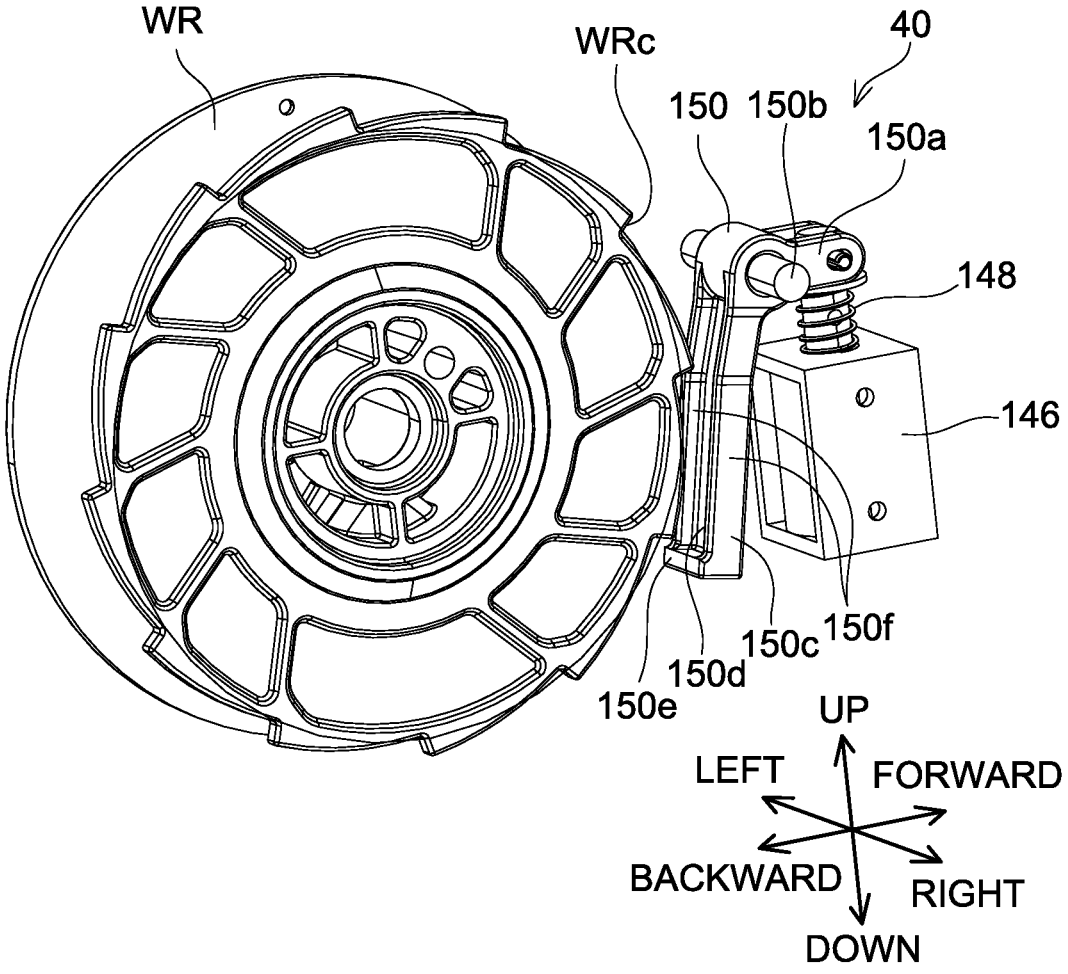
FIG. 24 is a perspective view seeing the wire reel WR and a brake mechanism 40 from the upper right rear side when a solenoid 146 is not electrically conducted in the rebar tying machine 2 according to the embodiment.
Figure 25:
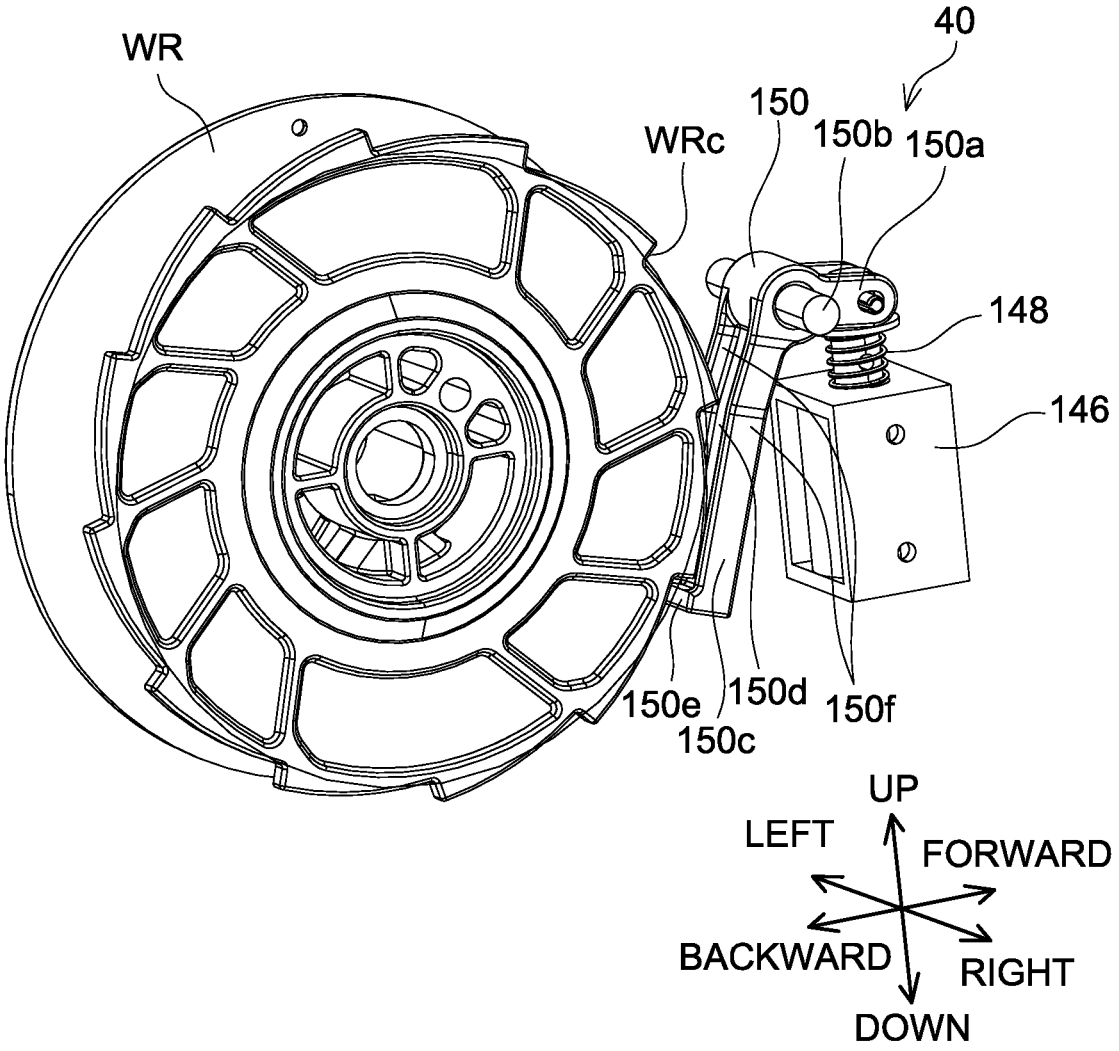
FIG. 25 is a perspective view seeing the wire reel WR and the brake mechanism 40 from the upper right rear side when the solenoid 146 is electrically conducted in the rebar tying machine 2 according to the embodiment.

The brake mechanism 40 shown in FIG. 7 stops rotation of the wire reel WR in conjunction with the feed mechanism 38 stopping feeding out the wire W. As shown in FIGS. 24 and 25, the brake mechanism 40 is provided with a solenoid 146, a compression spring 148, and a brake member 150. The solenoid 146 is electrically connected to the control board 200. The control board 200 is configured to control an operation of the solenoid 146. The brake member 150 is a single member provided with a driving arm 150*a* and a braking arm 150*c*. The brake member 150 is pivotably attached to the right housing 16 via a pivot shaft 150*b*. An output shaft of the solenoid 146 which moves in an up-and-down direction is connected to the driving arm 150*a* of the brake member 150. Further, the brake member 150 is biased in a pivoting direction along which the braking arm 150*c* separates away from the wire reel WR by the compression spring 148. The braking arm 150*c* of the brake member 150 is provided with a plate portion 150*d* having a wide plate shape, a distal end rib 150*e* protruding to a wire reel WR side at a distal end of the plate portion 150*d*, and side end ribs 150*f* protruding to the wire reel WR side on both sides of the plate portion 150*d*. The wire reel WR is provided with engaging portions WRc at predetermined angle intervals in its circumferential direction. The distal end rib 150*e* of the braking arm 150*c* engages with one of the engaging portions WRc. As shown in FIG. 24, in a state where the solenoid 146 is not electrically conductive, the braking arm 150*c* is separated away from the engaging portions WRc of the wire reel WR by biasing force of the compression spring 148. As shown in FIG. 25, in a state where the solenoid 146 is electrically conductive, the solenoid 146 drives the driving arm 150*a* and torque about the pivot shaft 150*b* is applied on the brake member 150, by which the brake member 150 pivots about the pivot shaft 150*b* and the distal end rib 150*e* of the braking arm 150*c* engages with one of the engaging portions WRc of the wire wheel WR. When the feed mechanism 38 feeds out the wire W, the control board 200 does not electrically conduct the solenoid 146 to separate the braking arm 150*c* away from the engaging portions WRc of the wire reel WR. Due to this, the wire reel WR can rotate freely, and the feed mechanism 38 can draw out the wire W from the wire reel WR. Further, when the feed mechanism 38 stops feeding out the wire W, the control board 200 electrically conducts the solenoid 146 to make the braking arm 150*c* engage with one of the engaging portions WRc of the wire reel WR. Due to this, the rotation of the wire wheel WR is prohibited. As such, the wire W can be prevented from becoming loose between the wire wheel WR and the feed mechanism 38 due to the wire wheel WR continuing to rotate by inertia even after the feed mechanism 38 has stopped feeding out the wire W.

As shown in FIG. 7, the brake mechanism 40 is disposed outside the right housing 16, and is housed in a space defined by the right housing 16 and the side-surface cover housing 18. As shown in FIG. 9, a brake opening 16*d* having a size that is substantially equal to a size of the braking arm 150*c* of the brake member 150 is provided in the right housing 16 of the reel housing compartment 20. With such a configuration, although the brake opening 16*d* is present between the wire reel WR and the solenoid 146, these members are partitioned from each other by the plate portion 150*d* of the braking arm 150*c*. As such, foreign matters can be prevented from moving to a solenoid 146 side from inside of the reel housing compartment 20 through the brake opening 16*d*. The solenoid 146 can be prevented from being affected by the foreign matters. As shown in FIG. 9, the braking arm 150*c* of the brake member 150 has a shape bent in the left-and-right direction such that its lower part is located at a leftwardly offset position as compared to its upper part. With such a configuration, the solenoid 146 can be disposed at a rightwardly offset position relative to the engaging portions WRc of the wire reel WR. In the rebar tying machine 2 of the present embodiment, a twist motor 170 of the twisting mechanism 46 to be described later is disposed on a frontside of the wire reel WR. According to the above configuration, the twist motor 170 of the twisting mechanism 46 and the solenoid 146 can be disposed side by side in the left-and-right direction, by which the tying machine body 4 can be made compact.

As shown in FIGS. 24 and 25, the solenoid 146 is disposed so that its longitudinal direction becomes substantially parallel to a tangential direction of rotary motion of a portion of the wire reel WR that is closest to the solenoid 146. Further, the solenoid 146 is disposed so that its longitudinal direction becomes substantially parallel to a shaft of the feed motor 72. With such a configuration, as shown in FIG. 7, the solenoid 146 can be disposed between the wire wheel WR and the feed motor 72 even if the wire wheel WR and the feed motor 72 are disposed close to each other in the front-and-rear direction of the tying machine body 4, by which the tying machine body 4 can be made compact. Further, by the solenoid 146 being interposed between the wire wheel WR and the feed motor 72, some degree of space can be ensured between the wire reel WR and the guide member 68 provided above the feed motor 72. When this space between the guide member 68 and the wire reel WR is too small, work for the user to pass the wire W drawn out from the wire wheel WR through the insertion hole 68*a* of the guide member 68 becomes difficult. According to the configuration of the present embodiment, some degree of space can be ensured between the wire reel WR and the guide member 68 provided above the feed motor 72 even if wire reel WR and the feed motor 72 are disposed close to each other, by which workability for the user can be improved.

In the rebar tying machine 2, a partition wall for partitioning the solenoid 146 and the wire reel WR may not be provided on the right housing 16 and the side-surface cover housing 18, and the solenoid 146 and the wire reel WR may be partitioned only by the brake member 150. In this case, the solenoid 146 and the wire reel WR can be disposed even closer to each other, and the tying machine body 4 can further be made compact.

In the rebar tying machine 2 of the present embodiment, the braking arm 150*c* of the brake member 150 is provided with the plate portion 150*d* having the wide plate shape, the distal end rib 150*e* protruding to the wire reel WR side at the distal end of the plate portion 150*d*, and the side end ribs 1501 protruding to the wire reel WR side on both sides of the plate portion 150*d*. With such a configuration, strength of the braking arm 150*c* is increased and durability of the brake member 150 can be improved. The side end ribs 150*f* may protrude to a solenoid 146 side.

As shown in FIG. 8, the cutting mechanism 44 is disposed in the front part of the tying machine body 4, and cuts the wire W with the wire W wound around the rebars R. As shown in FIGS. 18, 19, and 20, the cutting mechanism 44 is configured as a unit with the upper curl guide 90 of the guide mechanism 42. The cutting mechanism 44 is provided with a push plate 152, a pull plate 154, a first link arm 156, a second link arm 158, and the cutter 116. The push plate 152, the pull plate 154, and the first link arm 156 are pivotably connected to each other via a pivot shaft 160. Further, the push plate 152 and the pull plate 154 are pivotably supported by the guide arm 100 via a pivot shaft 162. The first link arm 156 is biased forward by a torsion spring 164. As shown in FIG. 20, the first link arm 156 and the second link arm 158 are pivotably connected to each other via a pivot shaft 166. The second link arm 158 is pivotably connected to the pivoting member 120 of the cutter 116 via a pivot shaft 168.

When a lower part of the push plate 152 is pushed forward by an operation of the twisting mechanism 46 to be described later, the first link arm 156 and the second link arm 158 move rearward, by which the pivoting member 120 of the cuter 116 pivots about the fixing member 118. Due to this, the wire W is sheared by the cutter piece 120*b* of the pivoting member 120 at a front end of the wire passage 118*a* of the fixing member 118. When a lower part of the pull plate 154 is pushed rearward by the operation of the twisting mechanism 46 from this state, the first link arm 156 and the second link arm 158 move forward, by which the pivoting member 120 of the cutter 116 pivots about the fixing member 118 and the cutter 116 returns to its initial state.

Figure 26:
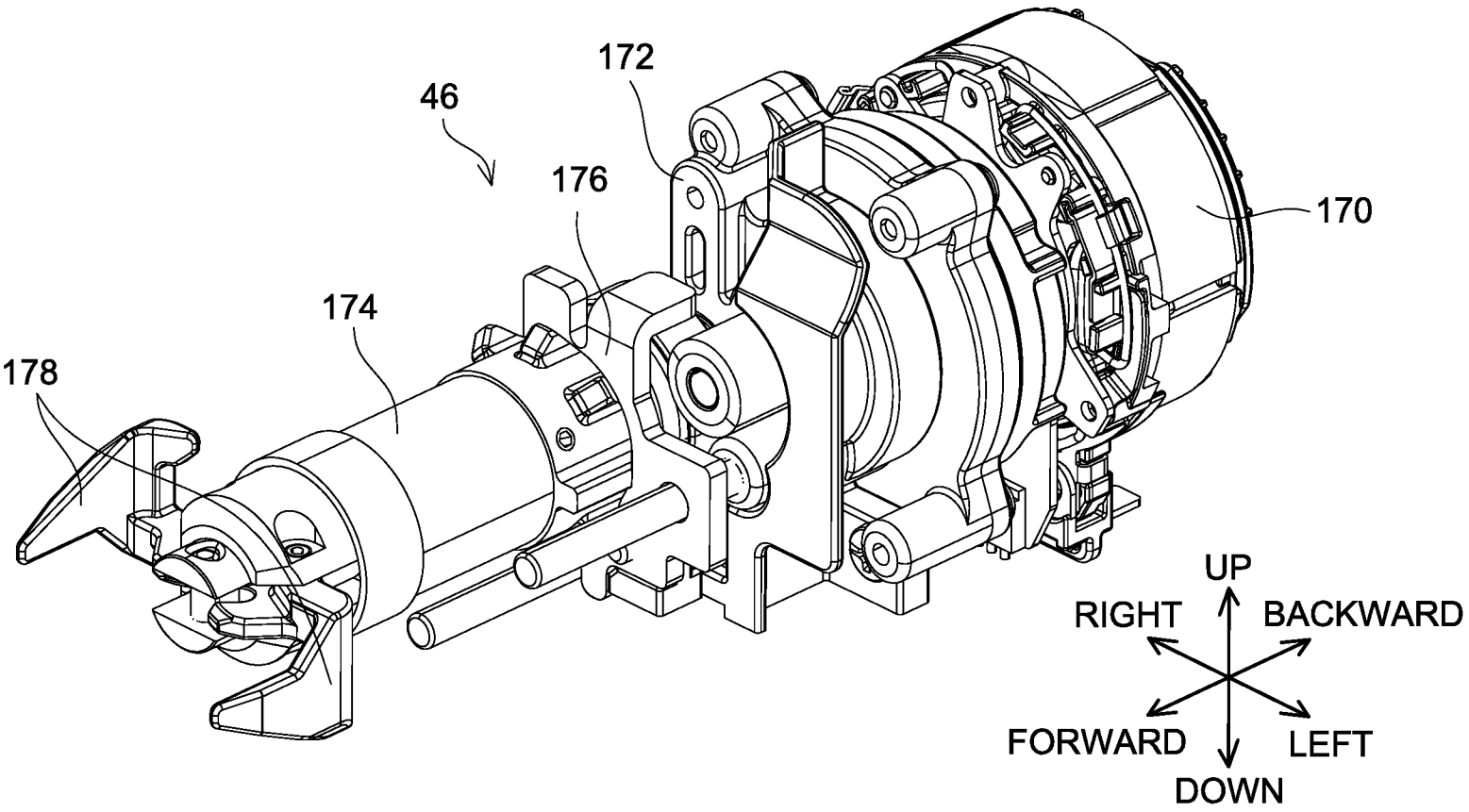
FIG. 26 is a perspective view seeing a twisting mechanism 46 of the rebar tying machine 2 according to the embodiment from the upper left front side.

The twisting mechanism 46 shown in FIG. 8 is disposed in an area from the front part of the tying machine body 4 to an intermediate part thereof in the front-and-rear direction. The twisting mechanism. 46 is configured to twist the wire W wound around the rebars R to tie the rebars R with the wire W. As shown in FIG. 26, the twisting mechanism 46 is provided with the twist motor 170, a reduction mechanism 172, a sleeve 174, a screw shaft that is not shown but disposed inside the sleeve 174, a pusher 176, and hooks 178.

The twist motor 170 is a direct current brushless motor. The twist motor 170 is electrically connected to the control board 200. The control board 200 is configured to control an operation of the twist motor 170. Rotation of the twist motor 170 is transmitted to the screw shaft through the reduction mechanism 172. The twist motor 170 is configured to rotate in a forward direction and in a reverse direction, according to which the screw shaft is configured to rotate in the forward direction and in the reverse direction. The sleeve 174 is disposed to cover a periphery of the screw shaft. In a state where rotation of the sleeve 174 is prohibited, the sleeve 174 moves forward when the screw shaft rotates in the forward direction, and the sleeve 174 moves rearward when the screw shaft rotates in the reverse direction. Further, in a state where the rotation of the sleeve 174 is allowed, the sleeve 174 rotates together with the screw shaft when the screw shaft rotates. The pusher 176 moves forward when the sleeve 174 moves forward, and moves rearward when the sleeve 174 moves rearward. When the sleeve 174 moves forward to a predetermined position from its initial position, the pusher 176 pushes the lower part of the push plate 152 of the cutting mechanism 44 forward, by which the pivoting member 120 of the cutter 116 pivots about the fixing member 118. To the contrary, when the sleeve 174 moves rearward to a predetermined position from its forward position, the pusher 176 pushes the lower part of the pull plate 154 of the cutting mechanism 44 rearward, by which the pivoting member 120 of the cutter 116 pivots about the fixing member 118. The hooks 178 are provided at a front end of the sleeve 174, and are configured to open and close according to a position of the sleeve 174 in the front-and-rear direction. The hooks 178 close to grip the wire W when the sleeve 174 moves forward. To the contrary, the hooks 178 open to release the wire W when the sleeve 174 moves rearward.

The control board 200 causes the twist motor 170 to rotate in the state where the wire W is wound around the rebars R. At this occasion, the rotation of the sleeve 174 is prohibited, so the sleeve 174 moves forward by the rotation of the screw shaft, the pusher 176 and the hooks 178 move forward therewith, the wire W is cut by the cutting mechanism 44, and the hooks 178 close to grip the wire W. Then, when the rotation of the sleeve 174 is allowed, the sleeve 174 rotates by the rotation of the screw shaft and the hooks 178 also rotate. Due to this, the wire W is twisted, and the rebars R are thereby tied. The twisting strength of the wire W may be preset by the user. When the wire W is twisted to the twisting strength as set, the control board 200 causes the twist motor 170 to rotate in the reverse direction. In doing so, the rotation of the sleeve 174 is prohibited, so the sleeve 174 moves rearward by the rotation of the screw shaft, the hooks 178 also move rearward while opening, and the wire W is thereby released. Further, the pusher 176 also moves rearward as the sleeve 174 moves rearward, and the cutting mechanism 44 returns to its initial state. After this, the pusher 176 and the hooks 178 move rearward to the initial positions, the rotation of the sleeve 174 is allowed, and the hooks 178 return to their initial angles.

Figure 36:
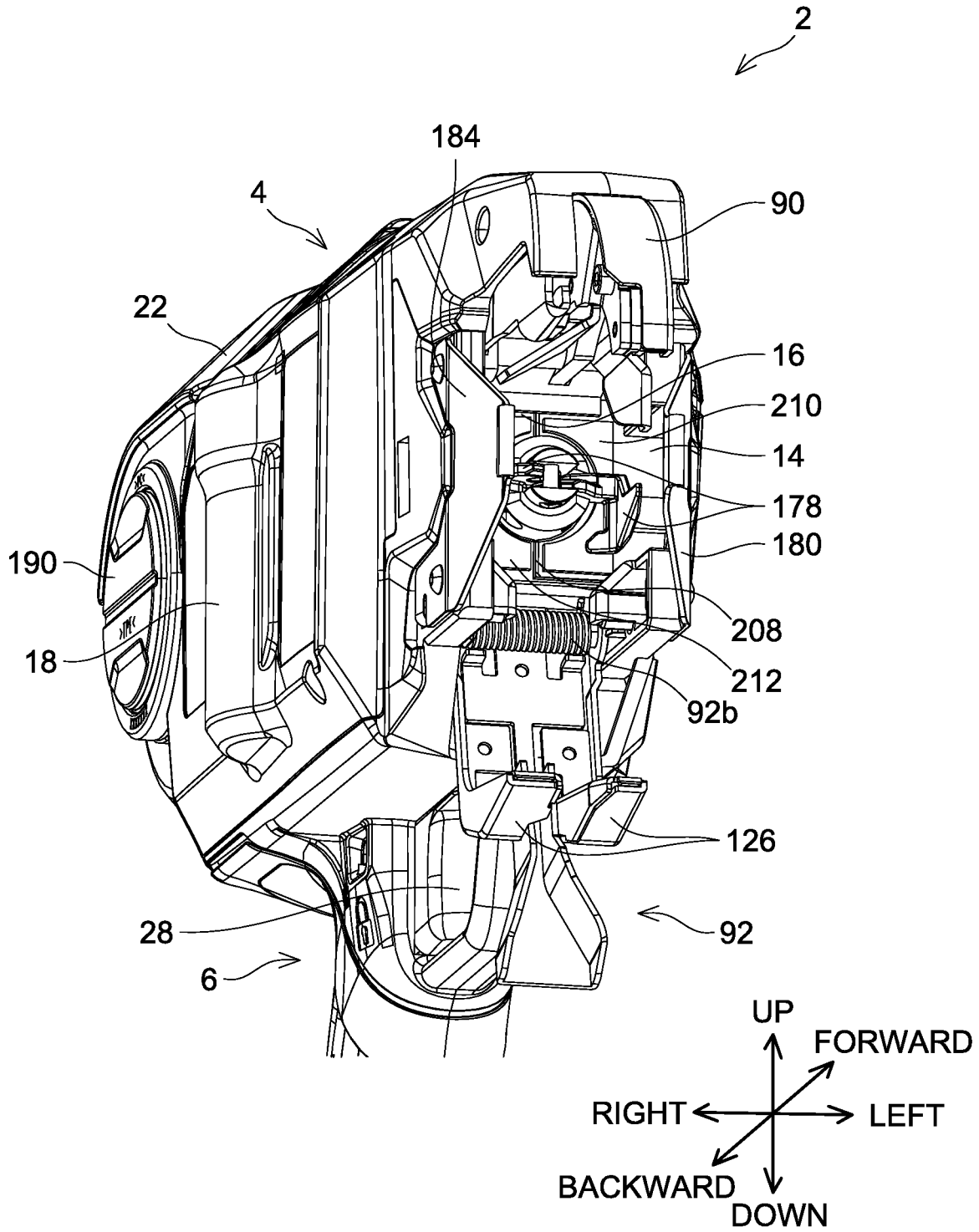
FIG. 36 is a perspective view seeing a structure near hooks 178 of the rebar tying machine 2 according to the embodiment from a lower left front side.

When the twisting mechanism 46 twists the wire W with the hooks 178, iron powder may be generated by the wire W being scraped. As shown in FIG. 36, an abutment portion 208 between the left housing 14 and the right housing 16 is present near the hooks 178. This abutment portion 208 has a gap provided therein, and thus the abutment portion 208 can be regarded as a communication portion through which iron powder can move from outside to inside the housing 12. When the iron powder generated by the wire W being scraped when the hooks 178 twist the wire W enters inside of the housing 12 through the abutment portion 208, it may adversely affect the operations of the devices housed inside the housing 12. In the rebar tying machine 2 of the present embodiment, a collecting magnet 210 for collecting the iron powder is attached to an outer wall surface of the left housing 14 near this abutment portion 208, and a collecting magnet 212 for collecting the iron powder is attached to the outer wall surface of the right housing 16 near this abutment portion 208. The collecting magnets 210, 212 are constituted of magnets with weak magnetism such as ferrite rubber magnets. According to this configuration, the iron powder generated by the wire W being scraped when the hooks 178 twist the wire W is collected by the collecting magnets 210, 212 before entering inside the housing 12. Due to this, the iron powder from the wire W can be suppressed from entering inside the housing 12 through the abutment portion 208.

As shown in FIG. 1, when the user sets the rebar tying machine 2 so that the plurality of rebars R is positioned between the upper curl guide 90 and the lower curl guide 92 and performs the pulling manipulation on the trigger 28, the rebar tying machine 2 performs a series of operations to wind the wire W around the rebars R by the feed mechanism 38, the brake mechanism 40, and the guide mechanism 42, and to cut the wire W and twist the wire W wound on the rebars R by the cutting mechanism 44 and the twisting mechanism 46.

Figure 27:
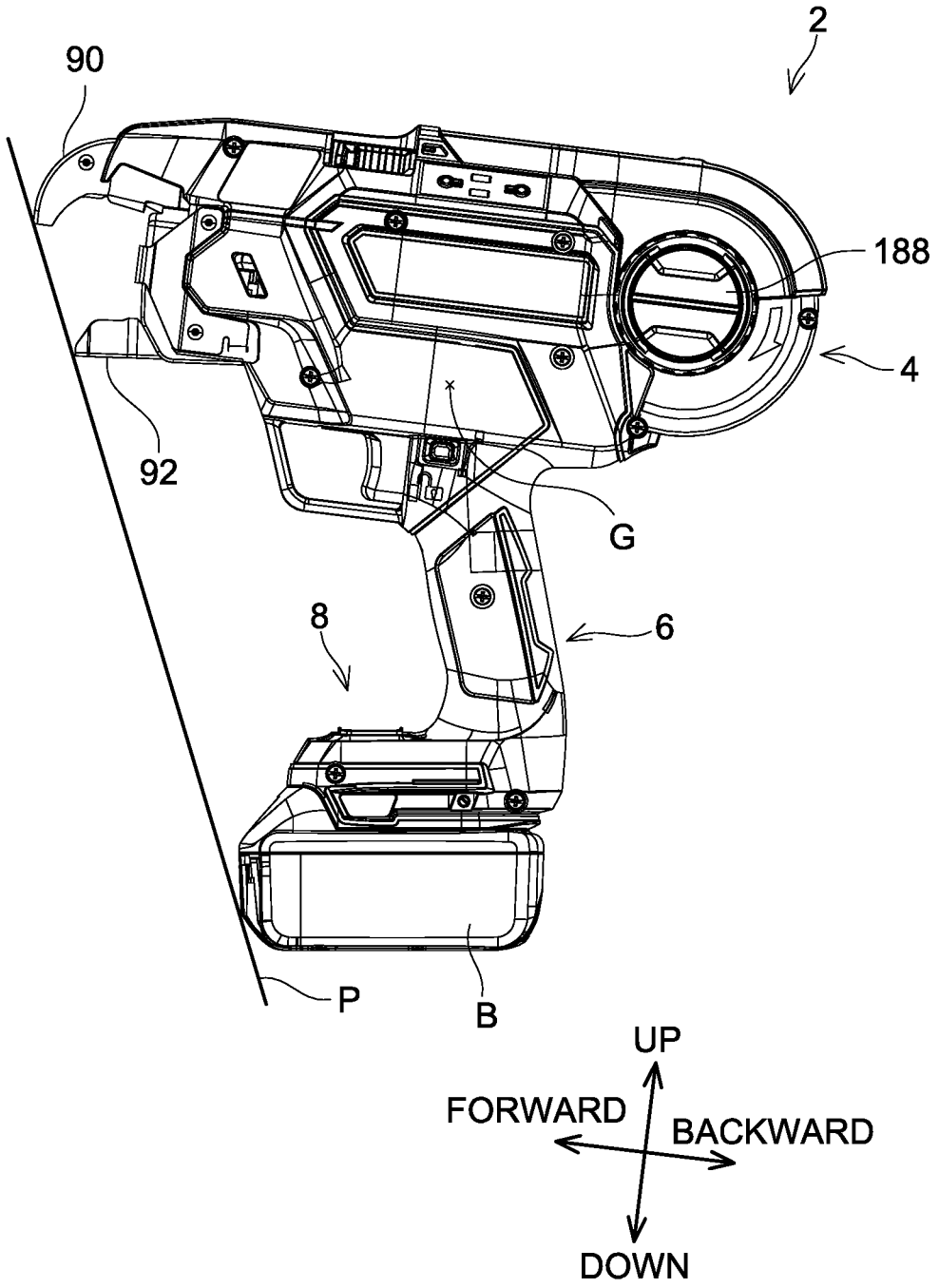
FIG. 27 is a left-side view seeing the rebar tying machine 2 according to the embodiment.
Figure 28:
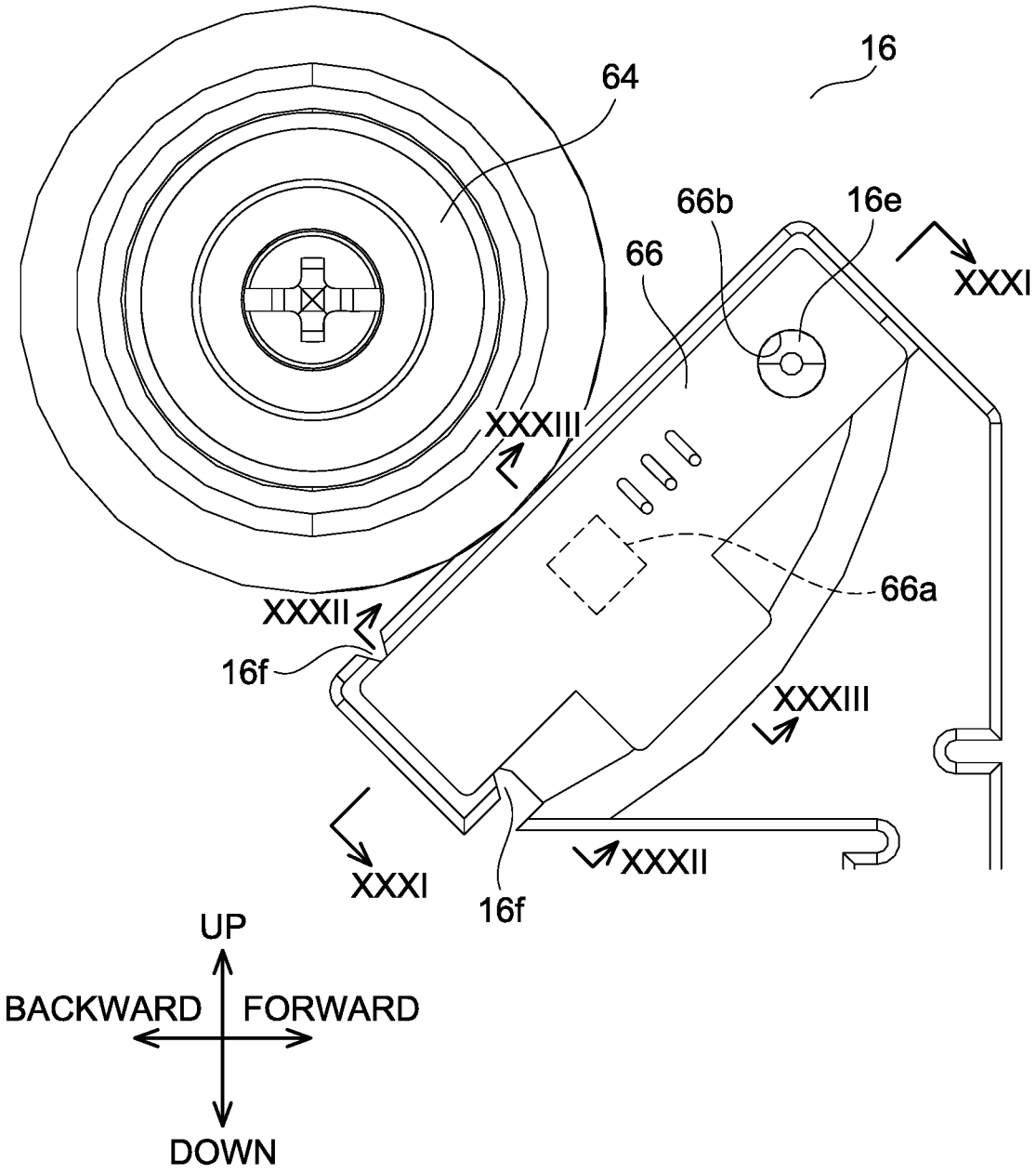
FIG. 28 is a right-side view seeing a state where the magnetic sensor 66 is attached to a right housing 16 of the rebar tying machine 2 according to the embodiment.
Figure 29:
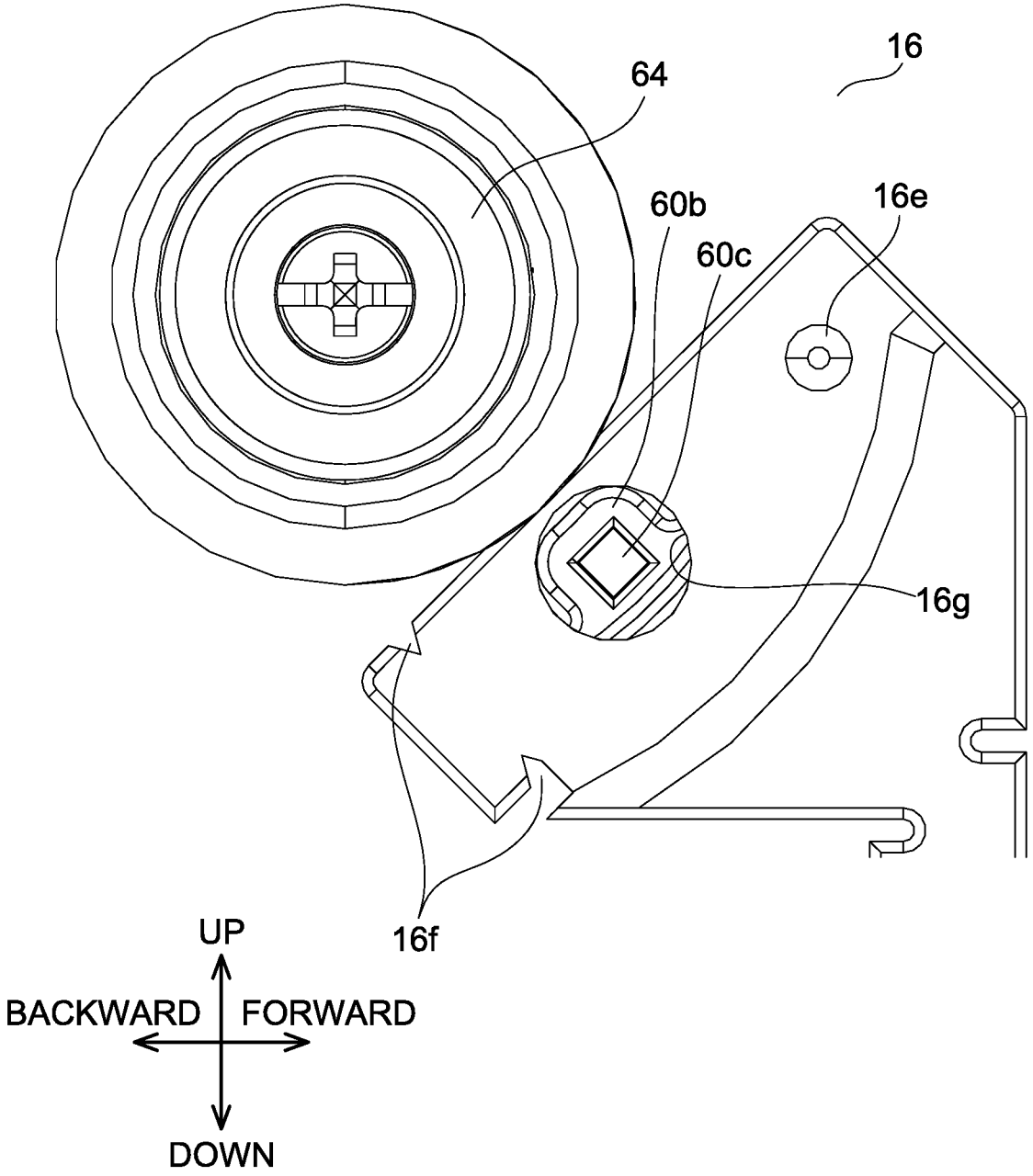
FIG. 29 is a right-side view seeing a state before the magnetic sensor 66 is attached to the right housing 16 of the rebar tying machine 2 according to the embodiment.
Figure 30:
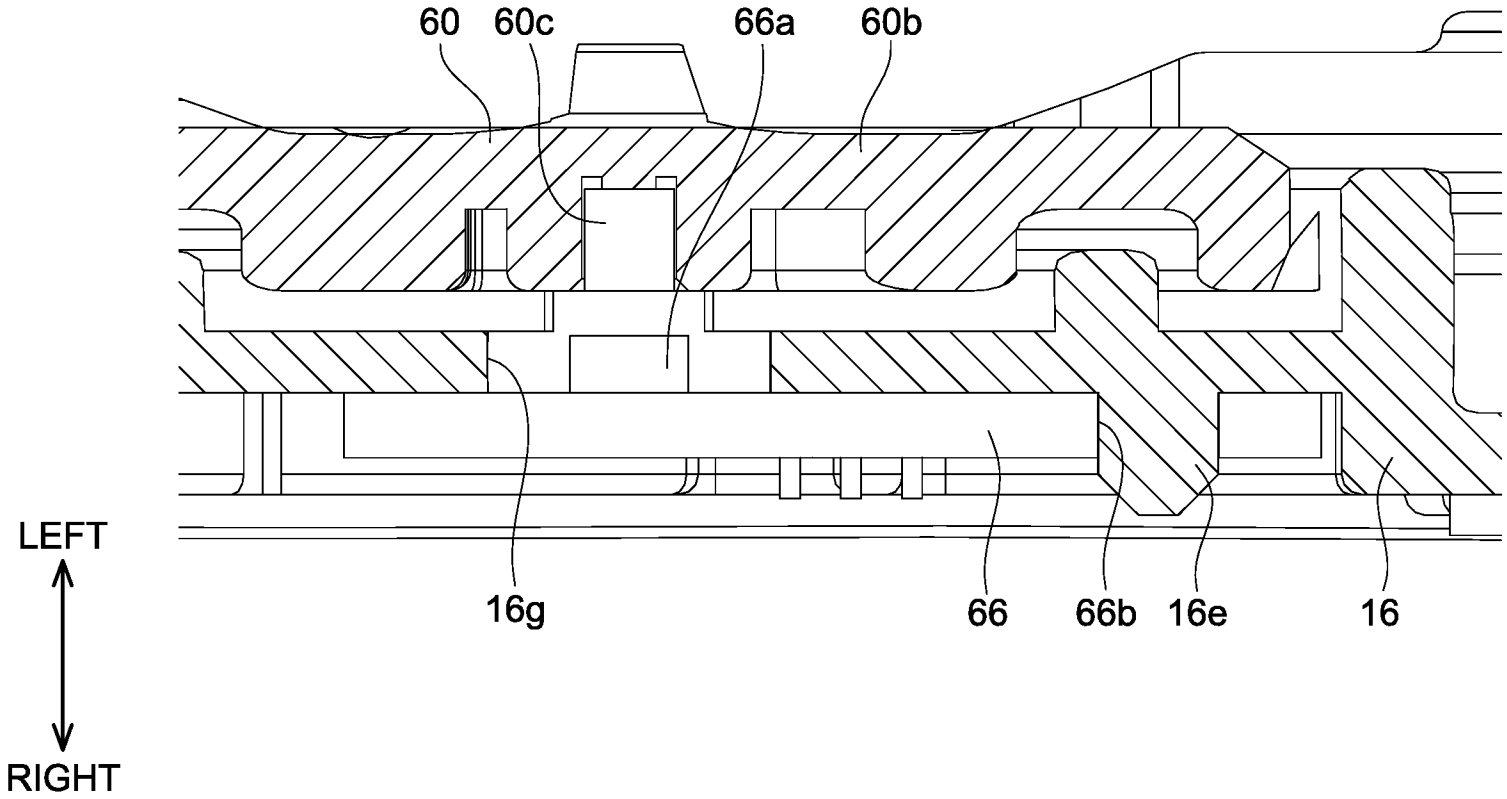
FIG. 30 is a cross-sectional view of the right housing 16, the turntable 60, and the magnetic sensor 66 of the rebar tying machine 2 according to the embodiment along a line XXXI-XXXI in FIG. 28.
Figure 31:
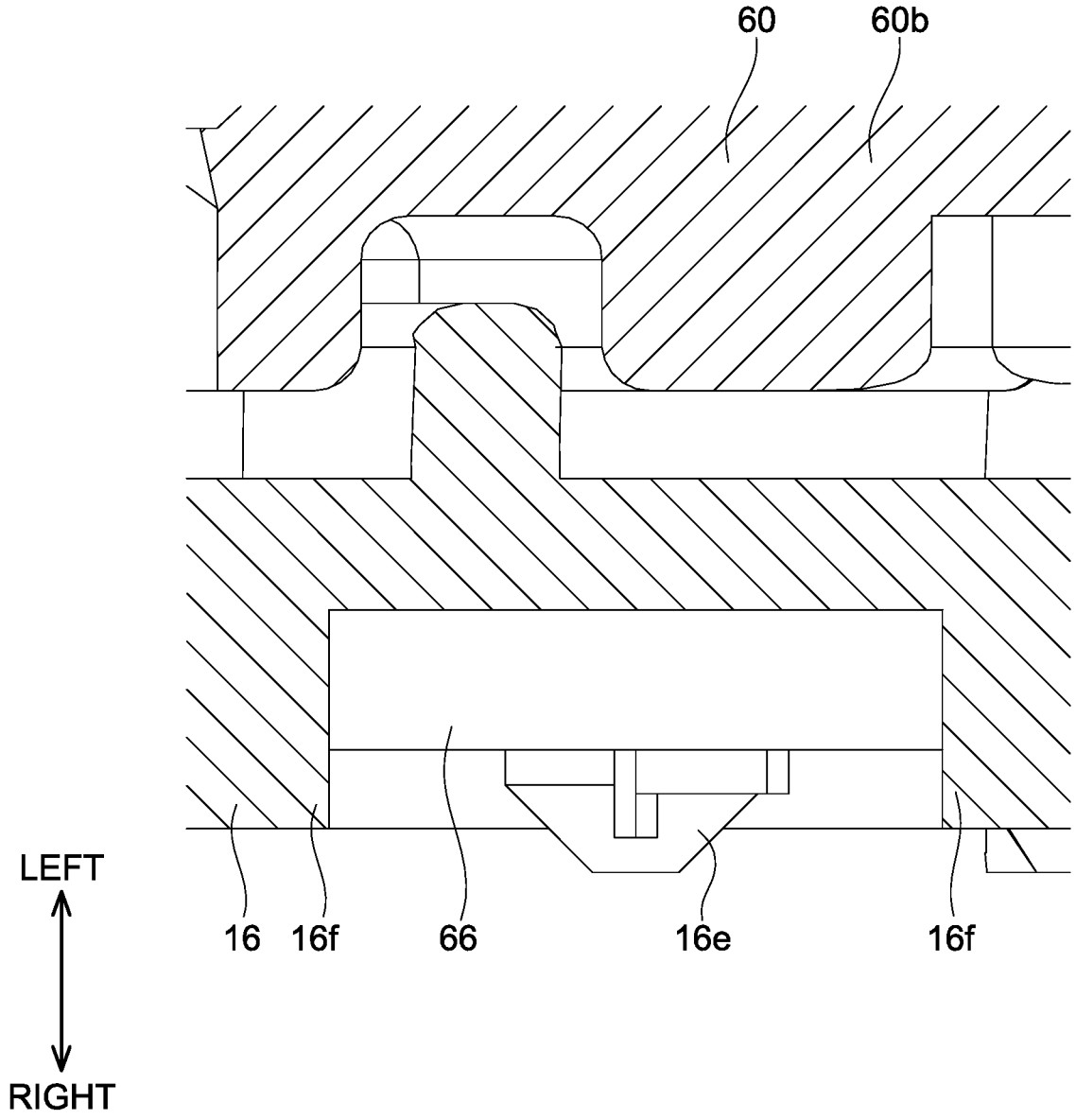
FIG. 31 is a cross-sectional view of the right housing 16, the turntable 60, and the magnetic sensor 66 of the rebar tying machine 2 according to the embodiment along a line XXXII-XXXII in FIG. 28.

As shown in FIG. 27, the rebar tying machine 2 of the present embodiment has the grip 6 tilted from an upper front side toward a lower rear side with respect to the tying machine body 4. A tilt angle of the grip 6 with respect to the tying machine body 4 is an angle between 65 to 80 degrees, and may be an angle between 70 to 75 degrees. With such a configuration, burden on a wrist of the user upon using the rebar tying machine 2 can be reduced. Further, in the rebar tying machine 2 of the present embodiment, a gravity center position G in a state where the battery B has been attached is located immediately above a proximal base of the grip 6 connected to the tying machine body 4. With such a configuration, the burden on the wrist of the user upon using the rebar tying machine 2 can be reduced. Moreover, in the rebar tying machine 2 of the present embodiment, a rear surface of the grip 6 and a rear surface of the battery receiver 8 are configured in shapes which are smoothly continued without any steps. With such a configuration, the smoothly-shaped portion comes into contact with a palm of the user when the rebar tying machine 2 is used in a downward orientation, and burden on the palm of the user can thereby be reduced.

In the rebar tying machine 2 of the present embodiment, when seen from below with a lower surface of the battery B as a reference, the gravity center position G in the state where the battery B has been attached is disposed within the lower surface of the battery B. With such a configuration, the rebar tying machine 2 can stably stand on its own even when placed with the lower surface of the battery 13 as a mount surface in the state where the battery B has been attached. Further, in the rebar tying machine 2 of the present embodiment, in regard to a sliding direction of the battery B, a rear-side end of the battery B is located on the front side than a rear-side end of the grip 6 when the battery B is attached. With such a configuration, the battery B can be suppressed from interfering with a forearm of the user when the user works by using the rebar tying machine 2.

In the rebar tying machine 2 of the present embodiment, a distal end of the lower curl guide 92 has a shape which does not exceed a plane P contacting a distal end of the upper curl guide 90 and a distal end of the battery B. With such a configuration, when the rebar tying machine 2 falls to the ground, the upper curl guide 90 or the battery B collides with the ground before the lower curl guide 92 collides with the ground. Since the lower curl guide 92 includes the mechanism which opens and closes relative to the tying machine body 4, its durability against impact is low as compared to the upper curl guide 90 and the battery B. With the configuration as above, damage to the lower curl guide 92 by impact can be suppressed. Even in a case where the distal end of the lower curl guide 92 has a shape which slightly protrudes from the plane P contacting the distal end of the upper curl guide 90 and the distal end of the battery B, the same effect as above can be achieved so long as a protruding amount thereof is small enough to be absorbed by elastic deformations of the lower curl guide 92 and the respective components constituting the open/close mechanism thereof and backlash between the respective components.

As shown in FIGS. 1 and 2, in the rebar tying machine of the present embodiment, an elastic cover 188 is provided on an outer surface of the cover retainer 54*a* of the housing mechanism 36 which retains the attaching portion 22*a* of the reel cover 22, and an elastic cover 190 is provided on an outer surface of the cover retainer 18*a* of the side-surface cover housing 18 which retains the attaching portion 22*b* of the reel cover 22. Both elastic covers 188, 190 are constituted of an elastic material such as elastomer. Due to this, even when the rebar tying machine 2 is laid down with its side downward, the elastic covers 188, 190 serve as bumpers to protect the components inside the rebar tying machine 2 from impact.

As above, the rebar tying machine 2 of the present embodiment is configured to tie the rebars R with the wire W. The rebar tying machine 2 includes the housing 12. The housing 12 includes the abutment portions 202, 208 (examples of a communication portion) that allow iron powder to move therethrough from outside to inside of the housing 12. The rebar tying machine 2 includes the collecting magnets 204, 206, 210, 212 for collecting iron powder. According to this configuration, even when the wire W is scraped and iron powder is generated, the collecting magnets 204, 206, 210, 212 collect the iron powder, so the iron powder can be suppressed from adversely affecting the operations of the devices housed inside the housing 12.

In the rebar tying machine 2 of the present embodiment, the collecting magnet 206 is provided inside the housing 12. According to this configuration, the collecting magnet 206 collects the iron powder even when the iron powder has entered inside the housing 12, so the iron powder can be suppressed from adversely affecting the operations of the devices housed inside the housing 12.

The rebar tying machine 2 of the present embodiment further includes the magnetic sensor 142 and the sensor magnet 144 provided corresponding to the magnetic sensor 142 inside the housing 12. The collecting magnet 206 is disposed inside the housing 12 on the path along which the iron powder moves from the abutment portion 202 to the sensor magnet 144. In the case where the magnetic sensor 142 and the sensor magnet 144 are housed inside the housing 12 as in the rebar tying machine 2, the detection of the sensor magnet 144 by the magnetic sensor 142 may be adversely affected when the iron powder having entered inside the housing 12 adheres to the sensor magnet 144. According to the above configuration, since the collecting magnet 206 is disposed on the path along which the iron powder moves to the sensor magnet 144 from the abutment portion 202, the iron powder can be suppressed from reaching to the sensor magnet 144 from the abutment portion 202 even when the iron powder has entered inside the housing 12.

In the rebar tying machine 2 of the present embodiment, the collecting magnet 206 is attached to the inner wall surface of the housing 12. In the rebar tying machine 2, the iron powder having entered inside the housing 12 tends to move along the inner wall surface of the housing 12. According to the above configuration, the iron powder having entered inside the housing 12 can effectively be collected by the collecting magnet 206.

In the rebar tying machine 2 of the present embodiment, the collecting magnets 204, 210, 212 are provided outside the housing 12. According to this configuration, even when the wire W is scraped and iron powder is generated, the collecting magnets 204, 210, 212 provided outside the housing 12 collect the iron powder before the iron powder enters inside the housing 12, so the iron powder can be suppressed from entering inside the housing 12.

In the rebar tying machine 2 of the present embodiment, the collecting magnets 204, 210, 212 are attached to the outer wall surface of the housing 12 near the abutment portions 202, 208. According to this configuration, the iron powder can be collected by the collecting magnets 204, 210, 212 before the iron powder enters inside the housing 12 from the abutment portions 202, 208 of the housing 12.

The rebar tying machine 2 of the present embodiment further includes the drive gear 78 (an example of a feeding roller) configured to feed out the wire W. The abutment portion 202 is disposed near the drive gear 78. In the configuration where the drive gear 78 feeds out the wire W, the wire W is scraped by friction with the drive gear 78, and iron powder is easily generated near the drive gear 78. Due to this, the iron powder is likely to enter inside the housing 12 due to the presence of the abutment portion 202 near the drive gear 78. According to the rebar tying machine 2 of the present embodiment, the iron powder generated near the drive gear 78 is collected by the collecting magnet 204, and the iron powder can be suppressed from adversely affecting the operations of the devices inside the housing 12.

The rebar tying machine 2 of the present embodiment further includes the hooks 178 configured to twist the wire W. The abutment portion 208 is disposed near the hooks 178. In the configuration where the hooks 178 twist the wire W, the wire W is scraped by friction between portions of the wire W in a process of the wire W being twisted, and iron powder is easily generated near the hooks 178. Due to this, when the abutment portion 208 is present near the hooks 178, the iron powder is likely to enter inside the housing 12. According to the rebar tying machine 2 of the present embodiment, the iron powder generated near the hooks 178 is collected by the collecting magnets 210, 212, and thus the iron powder can be suppressed from adversely affecting the operations of the devices inside the housing 12.

In the above embodiment, the configuration in which the drive gear 78 and the driven gear 80 grip the wire W and feed it out in the feed mechanism 38 is explained, however, the drive gear 78 and the driven gear 80 may respectively be a drive roller and a driven roller that are not provided with teeth on side surfaces thereof.

In the above embodiment, the configuration in which the collecting magnet 204 is disposed near the drive gear 78 and the driven gear 80 and the collecting magnets 210, 212 are disposed near the hooks 178 outside the housing 12 is explained, however, the collecting magnets may be provided at positions outside the housing 12 other than the positions described above.

In the above embodiment, the configuration in which the collecting magnet 206 is disposed on the path along which the iron powder moves from the abutment portion 202 to the sensor magnet 144 inside the housing 12 is explained, however, the collecting magnet may be provided at a position inside the housing 12 other than the position described above. For example, inside the housing 12, the collecting magnet may be disposed on a path along which the iron powder moves from the abutment portion 202 to the sensor magnet 60*c*, the sensor magnet 130 or another electronic component, may be disposed on a path along which the iron powder moves from the abutment portion 208 to the sensor magnet 60*c*, the sensor magnet 130, the sensor magnet 144 or another electronic component, and may be disposed on a path along which the iron powder moves from another communication portion to the sensor magnet 60*c*, the sensor magnet 130, the sensor magnet 144 or another electronic component.

What is claimed is:

1. A rebar tying machine configured to tie rebars with a wire, the rebar tying machine comprising:

a feed mechanism including a feeding roller that is configured to feed the wire;

a guide mechanism including a curl guide that is configured to guide the wire from the feed mechanism around the rebars;

a twisting mechanism including a hook that is configured to twist the wire after the wire is guided around the rebars;

a housing that supports the feed mechanism, the guide mechanism and the twisting mechanism and includes a grip grippable by a user and a communication portion that is an opening or a gap in the housing between an interior and an exterior of the rebar tying machine; and a collecting magnet that is in a fixed position relative to the grip, wherein the collecting magnet and the communication portion are configured and located such that iron powder that passes from the exterior of the rebar tying machine through the communication portion into the interior of the rebar typing machine, as a result of the wire being scraped outside the housing, is collected by the collecting magnet.

2. The rebar tying machine according to claim 1, wherein the collecting magnet is attached to an inner wall surface of the housing.

3. The rebar tying machine according to claim 2, further comprising:

a magnetic sensor inside the housing; and a sensor magnet inside the housing to correspond to the magnetic sensor and that is movable relative to the grip, wherein inside the housing, the collecting magnet is on a path along which the iron powder moves from the communication portion toward the sensor magnet.

4. The rebar tying machine according to claim 3, wherein the grip extends in an up-and-down direction, and the collecting magnet is above the sensor magnet.

5. The rebar tying machine according to claim 4, wherein the collecting magnet is below the feeding roller.

6. The rebar tying machine according to claim 5, wherein the communication portion is near the feeding roller.

7. The rebar tying machine according to claim 1, wherein the communication portion is near the hook.

* * * * *